US010283846B2

(12) United States Patent
Choi et al.

(10) Patent No.: US 10,283,846 B2
(45) Date of Patent: May 7, 2019

(54) ELECTRONIC DEVICE INCLUDING METAL HOUSING ANTENNA

(71) Applicant: Samsung Electronics Co., Ltd., Suwon-si, Gyeonggi-do (KR)

(72) Inventors: Wowjin Choi, Gumi-si (KR); Sungkee Kim, Gumi-si (KR); Dongryul Shin, Daegu (KR); Junhyuck Lee, Daegu (KR); Sooyoung Jang, Daegu (KR); Moonhyuk Choi, Daegu (KR); Kwangho Kim, Gumi-si (KR); Joonbo Park, Busan (KR); Hanjae Bae, Gumi-si (KR); Seunghun Shin, Gumi-si (KR); Chulhyung Yang, Gumi-si (KR); Jiwoo Lee, Gumi-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 169 days.

(21) Appl. No.: 15/375,778

(22) Filed: Dec. 12, 2016

(65) Prior Publication Data

US 2017/0201013 A1 Jul. 13, 2017

(30) Foreign Application Priority Data

Jan. 11, 2016 (KR) ..... 10-2016-0003370

(51) Int. Cl.
*H01Q 1/24* (2006.01)
*H01Q 1/48* (2006.01)
(Continued)

(52) U.S. Cl.
CPC ..... *H01Q 1/243* (2013.01); *H01Q 1/38* (2013.01); *H01Q 1/44* (2013.01); *H01Q 1/48* (2013.01);
(Continued)

(58) Field of Classification Search
CPC .. H01Q 1/24; H01Q 1/38; H01Q 1/44; H01Q 1/48
(Continued)

(56) References Cited

U.S. PATENT DOCUMENTS 7,405,703 B2 * 7/2008 Qi ..... H01Q 1/243 343/702
8,054,229 B2 * 11/2011 Kaneoya ..... H01Q 1/243 343/702
(Continued)

FOREIGN PATENT DOCUMENTS

CN 104577334 A 4/2015
EP 2 709 209 A1 3/2014
(Continued)

OTHER PUBLICATIONS

European Search Report dated Oct. 5, 2017, issued in the European Application No. 16205951.3.

*Primary Examiner* — Huedung X Mancuso
(74) *Attorney, Agent, or Firm* — Jefferson IP Law, LLP

(57) ABSTRACT

An electronic device is provided including a housing including a first plate, a second plate facing the first plate, and a side member between the first and second plate, a radio frequency (RF) circuit, a processor, a ground member, a first electric path connected between a first port of the RF circuit and a first point of a first conductive portion of the side member, a second electric path connected between a second port of the RF circuit and a first point of a second conductive portion of the side member, a third electric path connected between a second point of the first conductive portion and the ground member, a fourth electric path connected between a second point of the second conductive portion and the ground member, and a fifth electric path connected between one point of the second electric path and one point of the third electric path.

20 Claims, 19 Drawing Sheets

(51) Int. Cl.

| | |
|---|---|
| ***H01Q 1/50*** | (2006.01) |
| ***H01Q 1/38*** | (2006.01) |
| ***H01Q 1/44*** | (2006.01) |
| ***H01Q 5/00*** | (2015.01) |
| ***H01Q 9/00*** | (2006.01) |
| ***H01Q 21/28*** | (2006.01) |
| ***H01Q 1/52*** | (2006.01) |

(52) U.S. Cl.
CPC ..... *H01Q 1/50* (2013.01); *H01Q 1/521* (2013.01); *H01Q 5/00* (2013.01); *H01Q 9/00* (2013.01); *H01Q 21/28* (2013.01)

(58) Field of Classification Search
USPC ..... 343/702
See application file for complete search history.

(56) References Cited

U.S. PATENT DOCUMENTS

| | | | | |
|---|---|---|---|---|
| 2013/0135153 | A1 | 5/2013 | Wang et al. | |
| 2014/0078008 | A1* | 3/2014 | Kang | H01Q 5/35 343/702 |
| 2014/0078018 | A1* | 3/2014 | Wong | H01Q 21/28 343/893 |
| 2016/0233574 | A1* | 8/2016 | Xiong | H01Q 5/50 |

FOREIGN PATENT DOCUMENTS

| | | | |
|---|---|---|---|
| EP | 3 057 176 | A1 | 8/2016 |
| KR | 10-2011-0081094 | A | 7/2011 |

* cited by examiner

ELECTRONIC DEVICE INCLUDING METAL HOUSING ANTENNA

CROSS-REFERENCE TO RELATED APPLICATION(S)

This application claims the benefit under 35 U.S.C. § 119(a) of a Korean patent application filed on Jan. 11, 2016 in the Korean Intellectual Property Office and assigned Serial number 10-2016-0003370, the entire disclosure of which is hereby incorporated by reference.

TECHNICAL FIELD

The present disclosure relates to an electronic device including a metal housing that is used as an antenna of an electronic device.

BACKGROUND

In general, an electronic device (e.g., a smart phone) may include an antenna for wireless communication. At least a portion of the housing of the electronic device may be made of a metal. The metal housing may make the exterior of the electronic device beautiful and may reinforce the rigidity of the electronic device. As another example, the metal housing, or a portion thereof, may be utilized as an antenna.

The above information is presented as background information only to assist with an understanding of the present disclosure. No determination has been made, and no assertion is made, as to whether any of the above might be applicable as prior art with regard to the present disclosure.

SUMMARY

The metal housing may be divided into various portions by split portions (e.g., dielectric material) so that the portions of the metal housing may be utilized as radiators, respectively. In a split portion, a plurality of current paths may overlap with each other. Due to the overlapping of the paths, a radio frequency (RF) signal radiating efficiency may be lowered compared with a desired standard so that wireless communication may not be smoothly performed.

Aspects of the present disclosure are to address at least the above-mentioned problems and/or disadvantages and to provide at least the advantages described below. Accordingly, an aspect of the present disclosure is to provide an electronic device that is capable of performing wireless communication in a broad band by using a metal antenna including a split portion.

In accordance with an aspect of the present disclosure, an electronic device is provided. The electronic device includes a housing that includes a first plate facing in a first direction, a second plate facing in a second direction that is opposite to the first direction, and a side member at least partially enclosing a space between the first plate and the second plate, an RF circuit disposed within the housing, a processor disposed within the housing and electrically connected to the RF circuit, and a ground member disposed within the housing. The side member may include a first conductive portion, a second conductive portion, a third conductive portion, a first non-conductive portion, and a second non-conductive portion. The first non-conductive portion may be inserted between the first conductive portion and the second conductive portion, and the second non-conductive portion may be inserted between the first conductive portion and the third conductive portion. The RF circuit may include a first port and a second port.

The electronic device may further include a first electric path connected between the first port and a first point of the first conductive portion, a second electric path connected between the second port and a first point of the second conductive portion, a third electric path connected between a second point of the first conductive portion and the ground member, a fourth electric path connected between a second point of the second conductive portion and the ground member, and a fifth electric path connected between one point of the second electric path and one point of the third electric path.

Various embodiments of the present disclosure may provide an electronic device that is capable of performing wireless communication in a broad band by using a metal antenna including a split portion.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
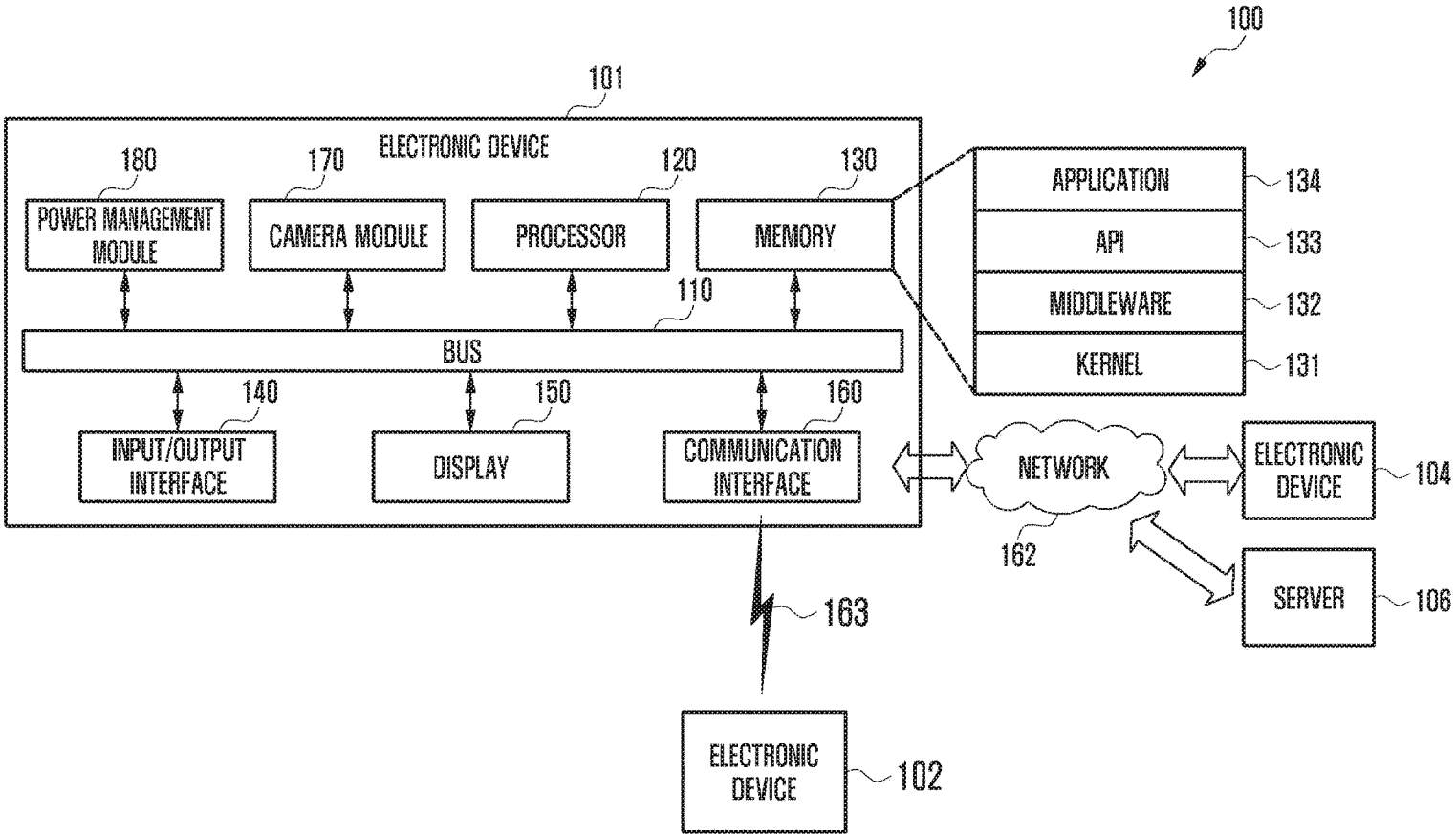
FIG. 1 is a block diagram illustrating a network environment according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The term "include" or "may include" which may be used in describing various embodiments of the present disclosure refers to the existence of a corresponding disclosed function, operation or component which can be used in various embodiments of the present disclosure and does not limit one or more additional functions, operations, or components. In various embodiments of the present disclosure, the terms such as "include" or "have" may be construed to denote a certain characteristic, number, operation, constituent element, component or a combination thereof, but may not be construed to exclude the existence of or a possibility of the addition of one or more other characteristics, numbers, operations, constituent elements, components or combinations thereof.

In various embodiments of the present disclosure, the expression "or" or "at least one of A or/and B" includes any or all of combinations of words listed together. For example, the expression "A or B" or "at least A or/and B" may include A, may include B, or may include both A and B.

The expression "1", "2", "first", or "second" used in various embodiments of the present disclosure may modify various components of the various embodiments but does not limit the corresponding components. For example, the above expressions do not limit the sequence and/or importance of the components. The expressions may be used for distinguishing one component from other components. For example, a first user device and a second user device may indicate different user devices although both of them are user devices. For example, without departing from the scope of the present disclosure, a first structural element may be referred to as a second structural element. Similarly, the second structural element also may be referred to as the first structural element.

When it is stated that a component is "coupled to" or "connected to" another component, the component may be directly coupled or connected to another component or a new component may exist between the component and another component. In contrast, when it is stated that a component is "directly coupled to" or "directly connected to" another component, a new component does not exist between the component and another component.

Unless defined differently, all terms used herein, which include technical terminologies or scientific terminologies, have the same meaning as that understood by a person skilled in the art to which the present disclosure belongs. Such terms as those defined in a generally used dictionary are to be interpreted to have the meanings equal to the contextual meanings in the relevant field of art, and are not to be interpreted to have ideal or excessively formal meanings unless clearly defined in the present description.

An electronic device according to various embodiments of the present disclosure may be a device including a communication function. For example, the electronic device may be one or a combination of a smart phone, a tablet personal computer (PC), a mobile phone, a video phone, an e-book reader, a desktop PC, a laptop PC, a netbook computer, a personal digital assistant (PDA), a camera, and a wearable device (e.g., a head-mounted-device (HMD) such as electronic glasses; electronic clothes; an electronic bracelet; an electronic necklace; an electronic accessory; an electronic tattoo; and a smart watch).

According to some embodiments of the present disclosure, the electronic device may be a smart home appliance having a communication function. The smart home appliance may include at least one of a television (TV), a digital versatile disc (DVD) player, an audio player, an air conditioner, a cleaner, an oven, a microwave oven, a washing machine, an air cleaner, a set-top box, a TV box (e.g., Samsung HomeSync™, Apple TV™, or Google TV™), game consoles, an electronic dictionary, an electronic key, a camcorder, and an electronic frame.

According to some embodiments of the present disclosure, the electronic device may include at least one of various types of medical devices (e.g., magnetic resonance angiography (MRA), magnetic resonance imaging (MRI), computed tomography (CT), a scanner, an ultrasonic device and the like), a navigation device, a global navigation satellite system (GNSS) receiver, an event data recorder (EDR), a flight data recorder (FDR), a vehicle infotainment device, electronic equipment for a ship (e.g., a navigation device for ship, a gyro compass and the like), avionics, a security device, a head unit for a vehicle, an industrial or home robot, an automatic teller machine (ATM) of financial institutions, a point of sale (POS) device of shops, and a device for internet of things (IoT) (e.g., a fire alarm, various sensors, electric or gas meter units, a sprinkler, a thermostat, a streetlamp, a toaster, sport outfits, a hot-water tank, a heater, a boiler and the like).

According to some embodiments of the present disclosure, the electronic device may include at least one of furniture or a part of a building/structure, an electronic board, an electronic signature receiving device, a projector, and various types of measuring devices (e.g., a water meter, an electricity meter, a gas meter, a radio wave meter and the like) including a camera function. The electronic device according to various embodiments of the present disclosure may be one or a combination of the above described various devices. Further, the electronic device according to various embodiments of the present disclosure may be a flexible device. It is apparent to those skilled in the art that the electronic device according to various embodiments of the present disclosure is not limited to the above described devices.

Hereinafter, an electronic device according to various embodiments of the present disclosure will be described with reference to the accompanying drawings. The term "user" used in various embodiments may refer to a person who uses an electronic device or a device (e.g., an artificial intelligence electronic device) which uses an electronic device.

FIG. 1 illustrates a network environment 100 including an electronic device 101 according to various embodiments of the present disclosure.

Referring to FIG. 1, the electronic device 101 may include various components including a bus 110, a processor 120, a memory 130, an input/output interface 140, a display 150, a communication interface 160, a camera module 170 and a power management module 180.

The bus 110 may be a circuit connecting the above described components and transmitting communication (e.g., a control message) between the above described components.

The processor 120 may include at least one of a central processing unit (CPU), an application processor (AP) and a communication processor (CP). The processor 120 may further include a graphics processing unit (GPU), an image signal processor (ISP) and so on. The ISP may be included in the camera module 170. The processor 120 may receive commands from other components (e.g., the memory 130, the input/output interface 140, the display 150, the communication interface 160, or the power management module 180) through the bus 110, analyze the received commands, and execute calculation or data processing according to the analyzed commands.

The memory 130 stores commands or data received from the processor 120 or other components (e.g., the input/output interface 140, the display 150, the communication interface 160, or the power management module 180) or generated by the processor 120 or other components. The memory 130 may store a software and/or a program. For example, the program may include a kernel 131, middleware 132, an application programming interface (API) 133, and an application program (or an application) 134. At least part of the kernel 131, the middleware 132 or the API 133 may refer to an operating system (OS).

The kernel 131 controls or manages system resources (e.g., the bus 110, the processor 120, or the memory 130) used for executing an operation or function implemented by the remaining other programming modules, for example, the middleware 132, the API 133, or the application 134. Further, the kernel 131 provides an interface for accessing individual components of the electronic device 101 from the middleware 132, the API 133, or the application 134 to control or manage the components.

The middleware 132 performs a relay function of allowing the API 133 or the application 134 to communicate with the kernel 131 to exchange data. Further, in operation requests received from the application 134, the middleware 132 performs a control for the operation requests (e.g., scheduling or load balancing) by using a method of assigning a priority, by which system resources (e.g., the bus 110, the processor 120, the memory 130 and the like) of the electronic device 101 can be used, to the application 134.

The API 133 is an interface by which the application 134 can control a function provided by the kernel 131 or the middleware 132 and includes, for example, at least one interface or function (e.g., command) for a file control, a window control, image processing, or a character control.

According to various embodiments of the present disclosure, the application 134 may include a short message service (SMS)/multimedia messaging service (MMS) application, an email application, a calendar application, an alarm application, a health care application (e.g., application measuring quantity of exercise or blood sugar) or an environment information application (e.g., application providing information on barometric pressure, humidity or temperature). Additionally, or alternatively, the application 134 may be an application related to an information exchange between the electronic device 101 and an external electronic device (e.g., electronic device 104). The application 134 related to the information exchange may include, for example, a notification relay application for transferring particular information to the external electronic device or a device management application for managing the external electronic device.

For example, the notification relay application may include a function of transmitting notification information generated by another application (e.g., an SMS/MMS application, an email application, a health care application or an environment information application) of the electronic device 101 to the external electronic device (e.g., electronic device 104). Additionally, or alternatively, the notification relay application may receive notification information from, for example, the external electronic device 104, and provide the received notification information to the user. The device management application may manage (e.g., install, remove, or update) at least a part of functions of the electronic device. For example, the device management application may turn on/off the external electronic device (or some components of the external electronic device), control a brightness of the display of the external electronic device or communicate with the electronic device 101, an application executed in the external electronic device 104, or a service (e.g., call service or message service) provided by the external electronic device 104.

According to various embodiments of the present disclosure, the application 134 may include an application designated according to an attribute (e.g., type of electronic device) of the external electronic device 104. For example, when the external electronic device 104 is a Moving Picture Experts Group phase 1 or phase 2 (MPEG-1 or MPEG-2) audio layer 3 (MP3) player, the application 134 may include an application related to music reproduction. Similarly, when the external electronic device 104 is a mobile medical device, the application 134 may include an application related to health care. According to an embodiment of the present disclosure, the application 134 may include at least one of an application designated to the electronic device 101 and an application received from an external electronic device (e.g., server 106 or electronic device 104).

The input/output interface 140 transmits a command or data input from the user through an input/output device 140 (e.g., a sensor, a keyboard, or a touch screen) to the processor 120, the memory 130, the communication interface 160, the camera module 170 or the display 150 through, for example, the bus 110. For example, the input/output interface 140 may provide data on a user's touch input through a touch screen to the processor 120. Further, the input/output interface 140 may output a command or data received through, for example, the bus 110, from the processor 120, the memory 130, the communication interface 160, or the camera module 170 through the input/output device (e.g., a speaker or a display). For example, the input/output interface 140 may output voice data processed through the processor 120 to the user through the speaker.

The display 150 may include, for example, liquid crystal display (LCD), flexible display, transparent display, light-emitting diode (LED) display, organic LED (OLED) display, microelectromechanical systems (MEMS) display, or electronic paper display. The display 150 may visually offer, for example, various contents (e.g., text, image, video, icon, symbol, etc.) to users. The display 150 may include a touch screen and receive, for example, a touch, gesture, proximity, or hovering input using an electronic pen or a user's body. According to an embodiment of the present disclosure, the display 150 may be one or more displays. For example, the display 150 may be included in the electronic device 101 or included in an external device (e.g., the electronic device 102 or 104) having a wired or wireless connection with the electronic device 101, thus outputting information offered by the electronic device 101 to users.

According to an embodiment of the present disclosure, the display 150 may be attachable to or detachable from the electronic device 101. For example, the display 150 may include an interface which can be mechanically or physically connected with the electronic device 101. According to an embodiment of the present disclosure, in case the display 150 is detached (e.g., separated) from the electronic device 101 by a user's selection, the display 150 may receive various control signals or image data from the power management module 180 or the processor 120, e.g., through wireless communication.

The communication interface 160 may establish communication between the electronic device 101 and any external device (e.g., the first external electronic device 102, the second external electronic device 104, or the server 106). For example, the communication interface 160 may be connected with a network 162 through wired or wireless communication and thereby communicate with any external device (e.g., the first external electronic device 102, the second external electronic device 104, or the server 106).

According to an embodiment of the present disclosure, the electronic device 101 may be connected with the first external electronic device 102 and the second external electronic device 104 without using the communication interface 160. For example, based on at least one of a magnetic sensor, a contact sensor, a light sensor, and the like that is equipped in the electronic device 101, the electronic device 101 may sense whether at least one of the first and second external electronic devices 102 and 104 is contacted with at least part of the electronic device 101, or whether at least one of the first and second external electronic device 102 and 104, respectively, is attached to at least part of the electronic device 101.

Wireless communication may use, as cellular communication protocol, at least one of long-term evolution (LTE), LTE-advanced (LTE-A), code division multiple access (CDMA), wideband CDMA (WCDMA), universal mobile telecommunications system (UMTS), wireless broadband (WiBro), global system for mobile communications (GSM), and the like, for example. A short-range communication 163 may include, for example, at least one of Wi-Fi, Bluetooth (BT), near field communication (NFC), magnetic secure transmission or near field magnetic data stripe transmission (MST), and GNSS, and the like. The GNSS may include at least one of, for example, a global positioning system (GPS), a global navigation satellite system (GLONASS), a BeiDou navigation satellite system (hereinafter, referred to as "BeiDou"), and Galileo (European global satellite-based navigation system). Hereinafter, the "GPS" may be interchangeably used with the "GNSS" in the present disclosure. Wired communication may include, for example, at least one of universal serial bus (USB), high definition multimedia interface (HDMI), recommended standard-232 (RS-232), plain old telephone service (POTS), and the like. The network 162 may include telecommunication network, for example, at least one of a computer network (e.g., local area network (LAN) or wide area network (WAN)), internet, and a telephone network.

The first and second external electronic devices 102 and 104 may be identical to, or different from, the electronic device 101. According to an embodiment of the present disclosure, the first and second external electronic devices 102 and 104 may include, for example, a plurality of electronic devices. According to an embodiment of the present disclosure, the server 106 may include a single server or a group of servers. According to various embodiments of the present disclosure, all or part of operations executed in the electronic device 101 may be executed in other electronic device(s), such as the first and second electronic devices 102 and 104 or the server 106.

According to an embodiment of the present disclosure, in case the electronic device 101 is used to perform a certain function or service automatically or by request, the electronic device 101 may request another device (e.g., the electronic device 102 or 104 or the server 106) to execute instead, or additionally at least part, of at least one or more functions associated with the required function or service. The requested device may execute the requested function and deliver the result of execution to the electronic device 101. Then, the electronic device 101 may offer the required function or service, based on the received result or by processing the received result. For the above, cloud computing technology, distributed computing technology, or client-server computing technology may be used, for example.

The camera module 170 may take a still image and a video. According to an embodiment of the present disclosure, the camera module 170 may include one or more image sensors (e.g., a front sensor and a rear sensor), lens, ISP, and a flash (e.g., LED, xenon lamp and so on).

The power management module 180 may control the power of the electronic device 101. The electronic device 101 may be an electronic device that is provided with power through a battery, but may not be limited thereto. According to an embodiment of the present disclosure, the power management module 180 may include a power management integrated circuit (PMIC), a charger IC, or a battery or fuel gauge. For example, when the power of the electronic device 101 is turned on, the power management module 180 (e.g., PMIC) may supply the power of a battery to other components (e.g., the processor 120, the memory 130, an image sensor, or the like).

According to an embodiment of the present disclosure, the power management module 180 may supply power to some (e.g., an embedded memory of a camera and an input/output interface for communication between the processor 120 and an embedded memory) of the components of an image sensor. Also, the power management module 180 may receive an instruction from the processor 120 through the bus 110, and may control supplying power in response to the instruction. For example, the power management module 180 may supply power to some other components (e.g., an analog block and a digital control block of the image sensor) of the image sensor in response to an instruction received from the processor 120.

The PMIC may use, for example, a wired and/or wireless charging method. The wireless charging method may include, for example, a magnetic resonance method, a magnetic induction method, an electromagnetic method, and the like. Additional circuits (e.g., a coil loop, a resonance circuit, a rectifier, etc.) for wireless charging may be further included. The battery gauge may measure, for example, the residual quantity of a battery, and a voltage, a current, or a temperature while charging. The battery may include, for example, a rechargeable battery and/or a solar battery.

Figure 2:
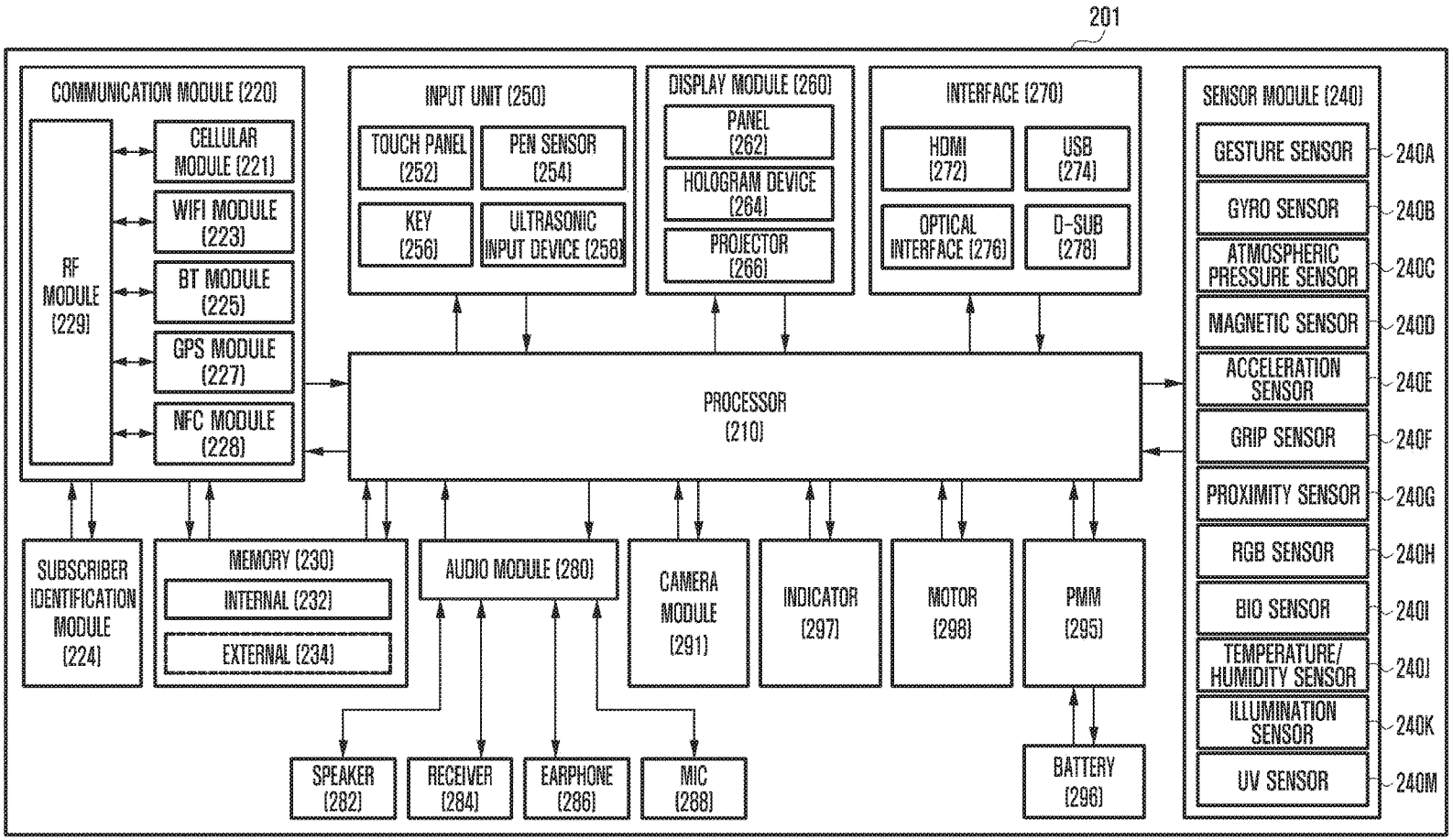
FIG. 2 is a block diagram illustrating a configuration of an electronic device according to various embodiments of the present disclosure.

FIG. 2 is a detailed block diagram showing a configuration of an electronic device 201 according to various embodiments of the present disclosure. For example, the electronic device 201 is capable of including part or all of the components in the electronic device 101 shown in FIG. 1.

Referring to FIG. 2, the electronic device 201 is capable of including one or more processors 210 (e.g., APs), a communication module 220, a subscriber identification module (SIM) 224, a memory 230, a sensor module 240, an input device 250, a display 260, an interface 270, an audio module 280, a camera module 291, a power management module 295, a battery 296, an indicator 297, and a motor 298.

Referring to FIG. 2, the processor 210 is capable of driving, for example, an OS or an application program to control a plurality of hardware or software components connected to the processor 210, processing various data, and performing operations. The processor 210 may be implemented as, for example, a system on chip (SoC). According to an embodiment of the present disclosure, the processor 210 may further include a GPU and/or an ISP. The processor 210 may also include at least part of the components shown in FIG. 2, e.g., a cellular module 221. The processor 210 is capable of loading commands or data received from at least one of other components (e.g., a non-volatile memory) on a volatile memory, processing the loaded commands or data. The processor 210 is capable of storing various data in a non-volatile memory.

The communication module 220 may include the same or similar configurations as the communication interface 27 shown in FIG. 2. For example, the communication module 220 is capable of including a cellular module 221, Wi-Fi module 223, BT module 225, GNSS module 226 (e.g., a GPS module, GLONASS module, BeiDou module or Galileo module), NFC module 227, MST module 228, and radio frequency (RF) module 229.

The cellular module 221 is capable of providing a voice call, a video call, an SMS service, an internet service, etc., through a communication network, for example. According to an embodiment of the present disclosure, the cellular module 221 is capable of identifying and authenticating an electronic device 201 in a communication network by using a SIM 224 (e.g., a SIM card). According to an embodiment of the present disclosure, the cellular module 221 is capable of performing at least part of the functions provided by the processor 210. According to an embodiment of the present disclosure, the cellular module 221 is also capable of including a CP.

Each of the Wi-Fi module 223, the BT module 225, the GNSS module 226, and the NFC module 227 is capable of including a processor for processing data transmitted or received through the corresponding module. The MST module 228 is capable of including a processor for processing data transmitted or received through the corresponding module. According to embodiments of the present disclosure, at least part of the cellular module 221, Wi-Fi module 223, BT module 225, GNSS module 226, NFC module 227, and MST module 228 (e.g., two or more modules) may be included in one IC or one IC package.

The RF module 229 is capable of transmission/reception of communication signals, e.g., RF signals. The RF module 229 is capable of including a transceiver, a power amp module (PAM), a frequency filter, a low noise amplifier (LNA), an antenna, etc. According to another embodiment of the present disclosure, at least one of the following modules: cellular module 221, Wi-Fi module 223, BT module 225, GNSS module 226, NFC module 227, and MST module 228 is capable of transmission/reception of RF signals through a separate RF module.

The SIM module 224 is capable of including a card including a SIM and/or an embodied SIM. The SIM module 224 is also capable of containing unique identification information, e.g., IC card identifier (ICCID), or subscriber information, e.g., international mobile subscriber identity (IMSI).

The memory 230 (e.g., memory 130 shown in FIG. 1) is capable of including an internal memory 232 or an external memory 234. The internal memory 232 is capable of including at least one of the following: a volatile memory, e.g., a dynamic random access memory (DRAM), a static RAM (SRAM), a synchronous dynamic RAM (SDRAM), etc.; and a non-volatile memory, e.g., a one-time programmable read-only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash memory, an NOR flash memory, etc.), a hard drive, a solid state drive (SSD), etc.

The external memory 234 is also capable of including a flash drive, e.g., a compact flash (CF), a secure digital (SD), a micro-SD, a mini-SD, an extreme digital (xD), a multimedia card (MMC), a memory stick, etc. The external memory 234 is capable of being connected to the electronic device 201, functionally and/or physically, through various interfaces.

The memory 230 is capable of storing payment information and a payment application serving as one of the application programs 134. The payment information may refer to credit card numbers and personal identification numbers (PINs), corresponding to a credit card. The payment information may also include user authentication information, e.g., fingerprints, facial features, voice information, etc.

When the payment application is executed by the processor 210, it may enable the processor 210 to perform: an interaction with the user to make payment (e.g., displaying a screen to select a card (or a card image) and obtaining information (e.g., a card number) corresponding to a selected card (e.g., a pre-specified card) from payment information); and an operation to control magnetic field communication (e.g., transmitting the card information to an external device (e.g., a card reading apparatus) through the NFC module 228). The following description provides detailed embodiments with operations of the components described above, referring to FIG. 2 to FIG. 17.

The sensor module 240 is capable of measuring/detecting a physical quantity or an operation state of the electronic device 201, and converting the measured or detected information into an electronic signal. The sensor module 240 is capable of including at least one of the following: a gesture sensor 240A, a gyro sensor 240B, an atmospheric pressure sensor 240C, a magnetic sensor 240D, an acceleration sensor 240E, a grip sensor 240F, a proximity sensor 240G, a color sensor 240H (e.g., a red, green and blue (RGB) sensor), a biometric sensor 240I, a temperature/humidity sensor 240J, an illuminance sensor 240K, and an ultraviolet (UV) sensor 240M. Additionally or alternatively, the sensor module 240 is capable of further including an E-nose sensor, an electromyography (EMG) sensor, an electroencephalogram (EEG) sensor, an electrocardiogram (ECG) sensor, an infrared (IR) sensor, an iris sensor and/or a fingerprint sensor. The sensor module 240 is capable of further including a control circuit for controlling one or more sensors included therein. In embodiments of the present disclosure, the electronic device 201 is capable of including a processor, configured as part of the processor 210 or a separate component, for controlling the sensor module 240. In this case, while the processor 210 is operating in sleep mode, the processor is capable of controlling the sensor module 240.

The input device 250 is capable of including a touch panel 252, a (digital) pen sensor 254, a key 256, or an ultrasonic input unit 258. The touch panel 252 may be implemented with at least one of the following: a capacitive touch system, a resistive touch system, an infrared touch system, and an ultrasonic touch system. The touch panel 252 may further include a control circuit. The touch panel 252 may also further include a tactile layer to provide a tactile response to the user.

The (digital) pen sensor 254 may be implemented with a part of the touch panel or with a separate recognition sheet. The key 256 may include a physical button, an optical key, or a keypad. The ultrasonic input unit 258 is capable of detecting ultrasonic waves, created in an input tool, through a microphone 288, and identifying data corresponding to the detected ultrasonic waves.

The display 260 (e.g., the display 150 shown in FIG. 2) is capable of including a panel 262, a hologram unit 264, or a projector 266. The panel 262 may include the same or similar configurations as the display 26 shown in FIG. 2. The panel 262 may be implemented to be flexible, transparent, or wearable. The panel 262 may also be incorporated into one module together with the touch panel 252. The hologram unit 264 is capable of showing a stereoscopic image in the air by using light interference. The projector 266 is capable of displaying an image by projecting light onto a screen. The screen may be located inside or outside of the electronic device 201. According to an embodiment of the present disclosure, the display 260 may further include a control circuit for controlling the panel 262, the hologram unit 264, or the projector 266.

The interface 270 is capable of including an HDMI 272, a USB 274, an optical interface 276, or a D-subminiature (D-sub) 278. The interface 270 may be included in the communication interface 27 shown in FIG. 2. Additionally or alternatively, the interface 270 is capable of including a mobile high-definition link (MHL) interface, an SD card/MMC interface, or an infrared data association (IrDA) standard interface.

The audio module 280 is capable of providing bidirectional conversion between a sound and an electronic signal. At least part of the components in the audio module 280 may be included in the input/output interface 25 shown in FIG. 2. The audio module 280 is capable of processing sound information input or output through a speaker 282, a receiver 284, earphones 286, microphone 288, etc.

The camera module 291 refers to a device capable of taking both still and moving images. According to an embodiment of the present disclosure, the camera module 291 is capable of including one or more image sensors (e.g., a front image sensor or a rear image sensor), a lens, an ISP, a flash (e.g., an LED or xenon lamp), etc.

The power management module 295 is capable of managing power of the electronic device 201. According to an embodiment of the present disclosure, the power management module 295 is capable of including a PMIC, a charger IC, or a battery or fuel gauge. The PMIC may employ wired charging and/or wireless charging methods. Examples of the wireless charging method are magnetic resonance charging, magnetic induction charging, and electromagnetic charging. To this end, the PMIC may further include an additional circuit for wireless charging, such as a coil loop, a resonance circuit, a rectifier, etc. The battery gauge is capable of measuring the residual capacity, charge in voltage, current, or temperature of the battery 296. The battery 296 takes the form of either a rechargeable battery or a solar battery.

The indicator 297 is capable of displaying a specific status of the electronic device 201 or a part thereof (e.g., the processor 210), e.g., a boot-up status, a message status, a charging status, etc. The motor 298 is capable of converting an electrical signal into mechanical vibrations, such as, a vibration effect, a haptic effect, etc. Although not shown, the electronic device 201 is capable of further including a processing unit (e.g., GPU) for supporting a mobile TV. The processing unit for supporting a mobile TV is capable of processing media data pursuant to standards, e.g., digital multimedia broadcasting (DMB), digital video broadcasting (DVB), or mediaFlo™, etc.

Each of the elements described in the present disclosure may be formed with one or more components, and the names of the corresponding elements may vary according to the type of the electronic device. In various embodiments of the present disclosure, the electronic device may include at least one of the above described elements described in the present disclosure, and may exclude some of the elements or further include other additional elements. Further, some of the elements of the electronic device according to various embodiments may be coupled to form a single entity while performing the same functions as those of the corresponding elements before the coupling.

Figure 3:
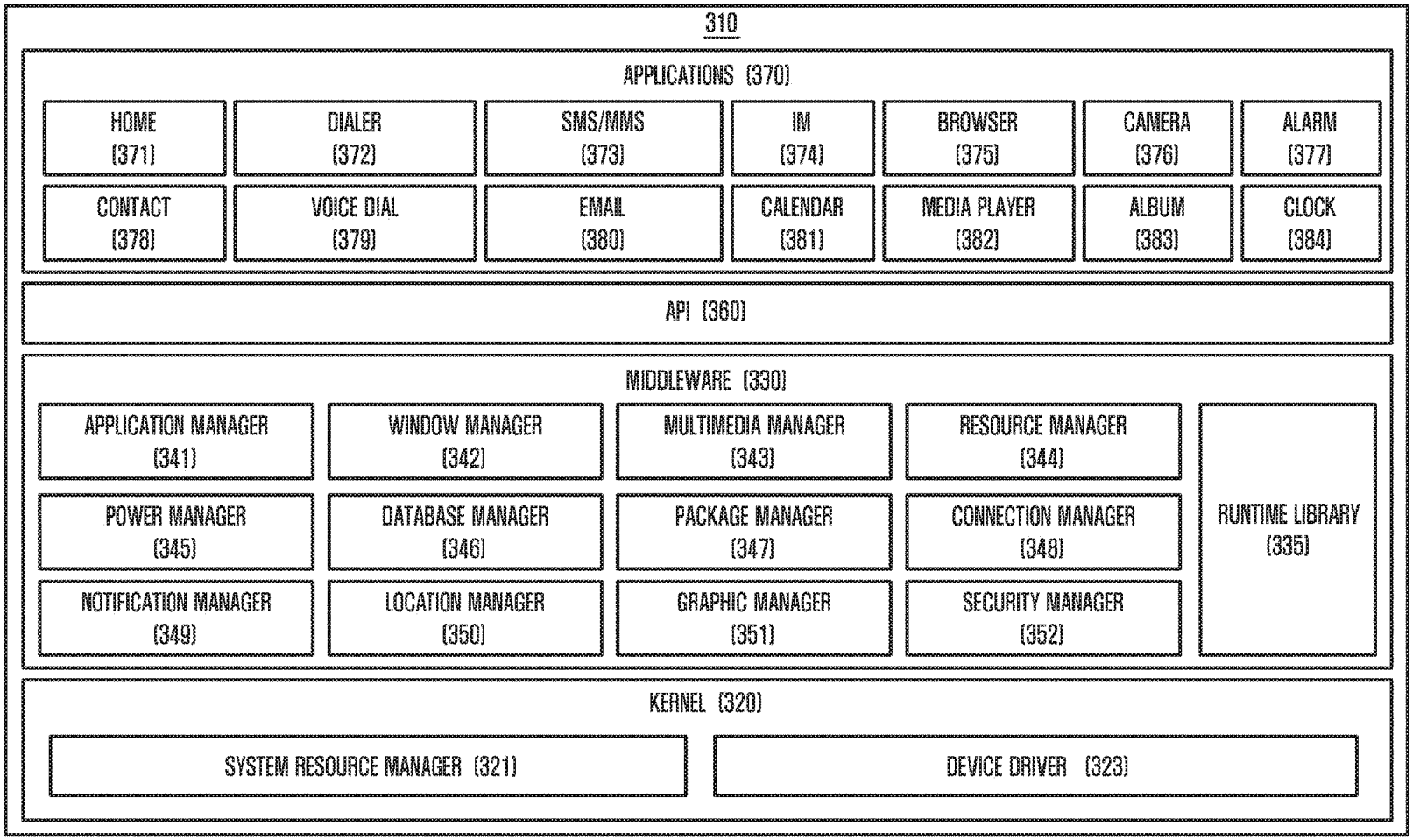
FIG. 3 is a block diagram illustrating a configuration of a program module according to various embodiments of the present disclosure.

FIG. 3 is a block diagram of a programming module according to various embodiments of the present disclosure. According to an embodiment of the present disclosure, the program module 310 is capable of including an OS for controlling resources related to the electronic device (e.g., electronic device 101) and/or various applications (e.g., application programs 134 shown in FIG. 1) running on the OS. The OS may be Android, iOS, Windows, Symbian, Tizen, Bada, etc.

Referring to FIG. 3, the program module 310 is capable of including a kernel 320, middleware 330, API 360 and/or applications 370. At least part of the program module 310 may be preloaded on the electronic device or downloaded from a server (e.g., an electronic device 102 or 104, server 106, etc.).

The kernel 320 (for example, kernel 131) may include a system resource manager 321 and/or a device driver 323. The system resource manager 321 may include, for example, a process manager, a memory manager, and a file system manager. The system resource manager 321 may perform a system resource control, allocation, and recall. The device driver 323 may include, for example, a display driver, a camera driver, a BT driver, a shared memory driver, a USB driver, a keypad driver, a Wi-Fi driver, and an audio driver. Further, according to an embodiment of the present disclosure, the device driver 312 may include an inter-process communication (IPC) driver.

The middleware 330 may provide a function used in common by the applications 370. Further, the middleware 330 may provide a function through the API 360 to allow the applications 370 to efficiently use limited system resources within the electronic device. According to an embodiment of the present disclosure, the middleware 330 (for example, the middleware 132) may include at least one of a runtime library 335, an application manager 341, a window manager 342, a multimedia manager 343, a resource manager 344, a power manager 345, a database manager 346, a package manager 347, a connection manager 348, a notification manager 349, a location manager 350, a graphic manager 351, and a security manager 352.

The runtime library 335 may include, for example, a library module used by a complier to add a new function through a programming language while the applications 370 are executed. According to an embodiment of the present disclosure, the runtime library 335 executes input and output, management of a memory, a function associated with an arithmetic function and the like.

The application manager 341 may manage, for example, a life cycle of at least one of the applications 370. The window manager 342 may manage graphical user interface (GUI) resources used on the screen. The multimedia manager 343 may detect a format used for reproducing various media files and perform an encoding or a decoding of a media file by using a coder-decoder (codec) suitable for the corresponding format. The resource manager 344 manages resources such as a source code, a memory, or a storage space of at least one of the applications 370.

The power manager 345 may operate together with a basic input/output system (BIOS) to manage a battery or power and provides power information used for the operation. The database manager 346 may manage generation, search, and change of a database to be used by at least one of the applications 370. The package manager 347 may manage an installation or an update of an application distributed in a form of a package file.

The connection manager 348 may manage, for example, a wireless connection such as Wi-Fi or BT. The notification manager 349 may display or notify a user of an event such as an arrival message, an appointment, a proximity alarm or the like, in a manner that does not disturb the user. The location manager 350 may manage location information of the electronic device. The graphic manager 351 may manage a graphic effect provided to the user or a user interface related to the graphic effect. The security manager 352 provides a general security function used for a system security or a user authentication. According to an embodiment of the present disclosure, when the electronic device (for example, the electronic device 11) has a call function, the middleware 330 may further include a telephony manager for managing a voice of the electronic device or a video call function.

The middleware 330 is capable of including modules configuring various combinations of functions of the above described components. The middleware 330 is capable of providing modules specialized according to types of operation systems to provide distinct functions. The middleware 330 may be adaptively configured in such a way as to remove part of the existing components or to include new components.

The API 360 (for example, API 133) may be a set of API programming functions, and may be provided with a different configuration according to an OS. For example, in Android or iOS, a single API set may be provided for each platform. In Tizen, two or more API sets may be provided.

The applications 370 (e.g., application programs 134) may include one or more applications for performing various functions, e.g., home 371, dialer 372, SMS/MMS 373, instant message (IM) 374, browser 375, camera 376, alarm 377, contacts 378, voice dial 379, email 380, calendar 381, media player 382, album 383, clock 384, health care (e.g., an application for measuring amount of exercise, blood sugar level, etc.), and environment information (e.g., an application for providing atmospheric pressure, humidity, temperature, etc.).

According to an embodiment of the present disclosure, the applications 370 are capable of including an application for supporting information exchange between an electronic device (e.g., electronic device 101) and an external device (e.g., electronic devices 102 and 104), which is hereafter called 'information exchange application'). The information exchange application is capable of including a notification relay application for relaying specific information to external devices or a device management application for managing external devices.

For example, the notification relay application is capable of including a function for relaying notification information, created in other applications of the electronic device (e.g., SMS/MMS application, email application, health care application, environment information application, etc.) to external devices (e.g., electronic devices 102 and 104). In addition, the notification relay application is capable of receiving notification information from external devices to provide the received information to the user.

The device management application is capable of managing (e.g., installing, removing or updating) at least one function of an external device (e.g., electronic devices 102 and 104) communicating with the electronic device. Examples of the function are a function of turning-on/off the external device or part of the external device, a function of controlling the brightness (or resolution) of the display, applications running on the external device, services provided by the external device, etc. Examples of the services are a call service, messaging service, etc.

According to an embodiment of the present disclosure, the applications 370 are capable of including an application (e.g., a health care application of a mobile medical device, etc.) specified attributes of an external device (e.g., electronic devices 102 and 104). According to an embodiment of the present disclosure, the applications 370 are capable of including applications received from an external device (e.g., a server 106, electronic devices 102 and 104). According to an embodiment of the present disclosure, the applications 370 are capable of including a preloaded application or third party applications that can be downloaded from a server. It should be understood that the components of the program module 310 may be called different names according to types of OSs.

According to various embodiments of the present disclosure, at least part of the program module 310 can be implemented with software, firmware, hardware, or any combination of two or more of them. At least part of the program module 310 can be implemented (e.g., executed) by a processor (e.g., processor 120). At least part of the programming module 310 may include modules, programs, routines, sets of instructions or processes, etc., in order to perform one or more functions.

Figure 4A:
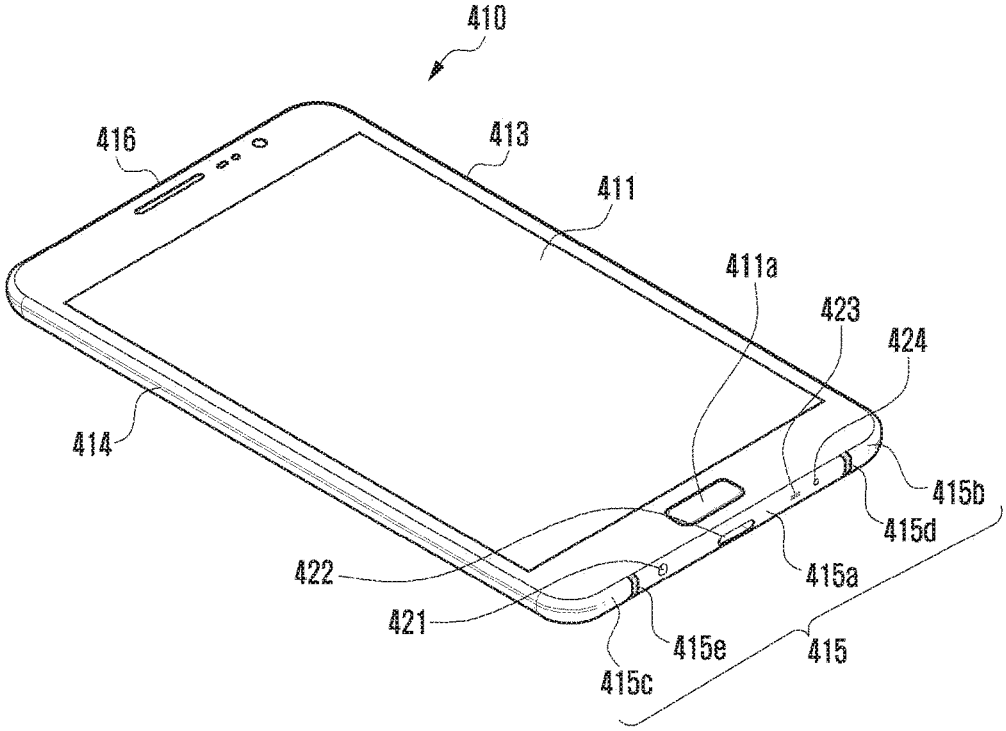
FIG. 4A is a perspective view illustrating a front side and a bottom side of an electronic device according to various embodiments of the present disclosure.
Figure 4B:
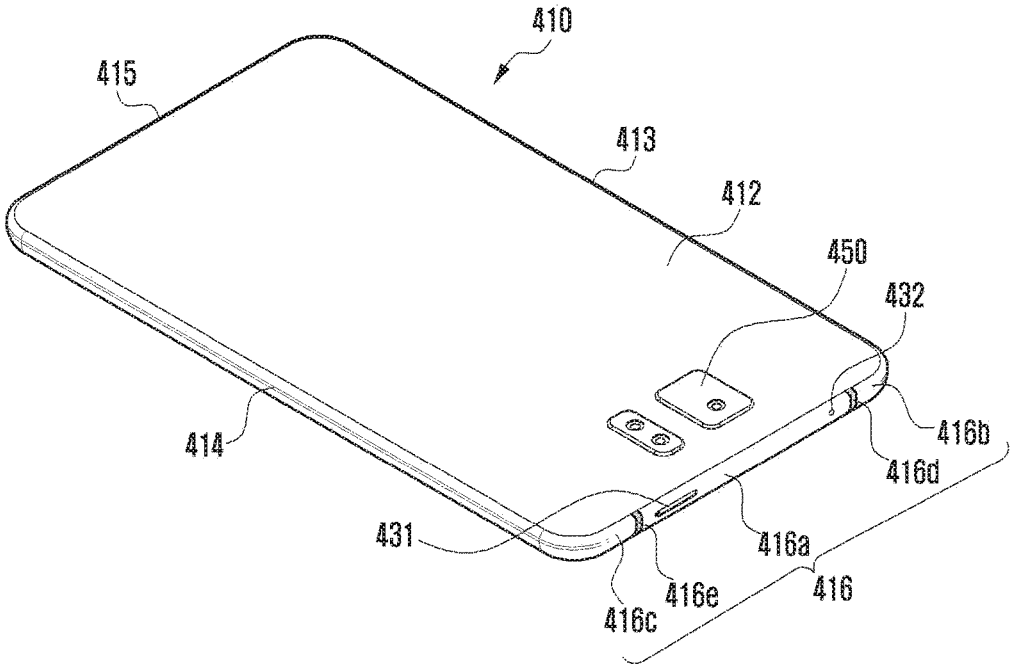
FIG. 4B is a perspective view illustrating a rear side and a top side of the electronic device according to various embodiments of the present disclosure.
Figure 4C:
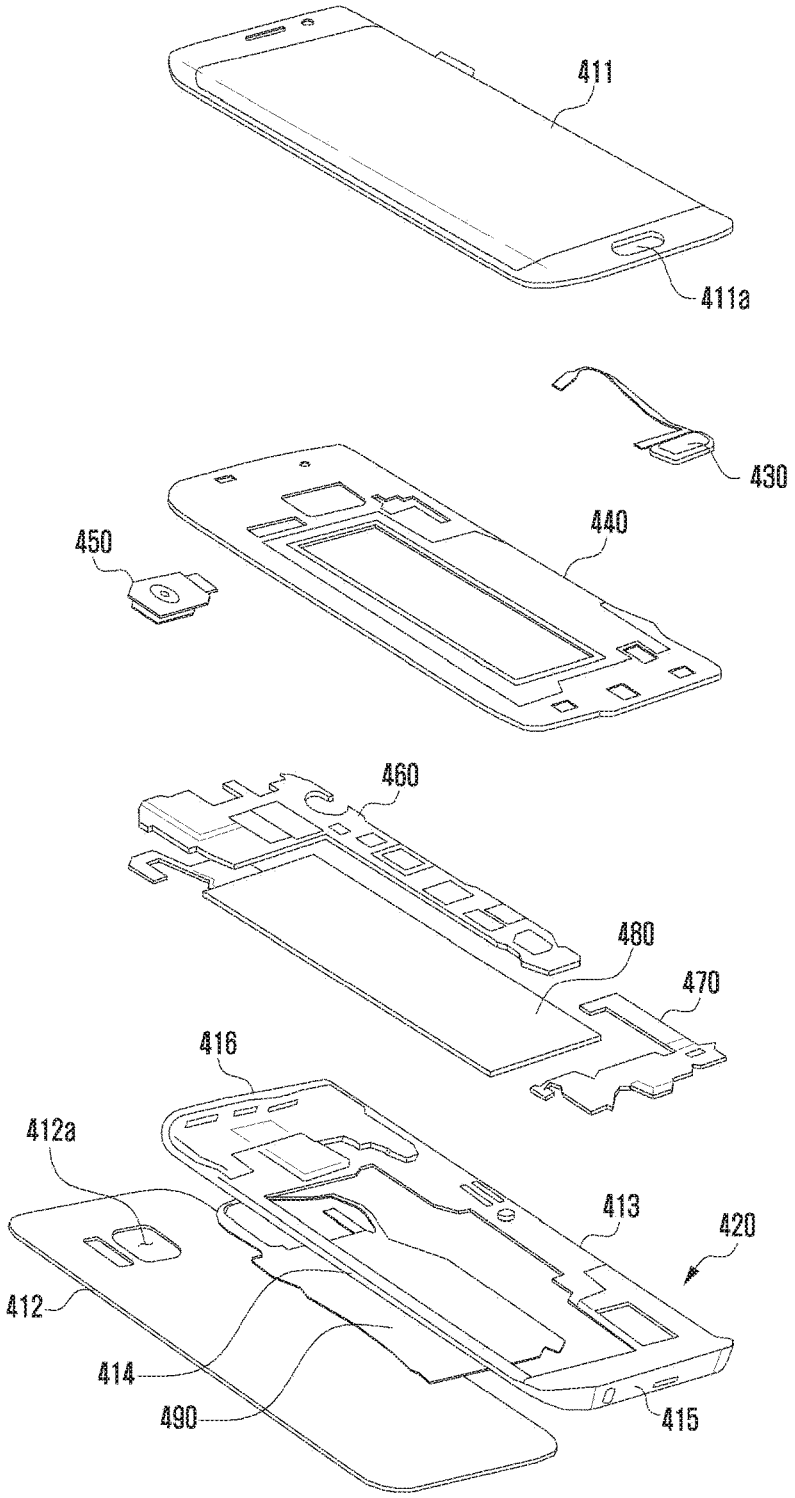
FIG. 4C is an exploded perspective view illustrating the structure of the electronic device according to various embodiments of the present disclosure.

FIG. 4A is a perspective view illustrating a front side and a bottom side of an electronic device according to various embodiments of the present disclosure, FIG. 4B is a perspective view illustrating a rear side and a top side of the electronic device according to various embodiments of the present disclosure, and FIG. 4C is an exploded perspective view illustrating the structure of the electronic device according to various embodiments of the present disclosure.

Referring to FIGS. 4A to 4C, an electronic device (e.g., the electronic device 101) may generally include various electronic components and a housing 410 configured to protect the electronic components. The housing 410 may include a first plate 411 that faces in a first direction, a second plate 412 that faces in a second direction that is substantially opposite to the first direction, and a side member 420 that encloses at least a portion of a space between the first plate 411 and the second plate 412. For example, the first plate 411 may be a cover that forms the front face of the electronic device, and a display may be exposed through a portion of the cover. For example, the second plate 412 may be a cover that forms rear front face of the electronic device. For example, the side member 420 may include a right side cover 413 configured to form a right side face of the electronic device, a left side cover 414 configured to form a left side face of the electronic device, a bottom side cover 415 configured to form a bottom side face of the electronic device, and a top side cover 416 configured to form a top side face of the electronic device.

Referring to FIG. 4A, the bottom side cover 415 is at least partially formed of a metal to be used as a radiator to radiate an RF signal. For example, the bottom side cover 415 may include a first metal portion 415*a*, a second metal portion 415*b*, a third metal portion 415*c*, a first non-metal portion 415*d*, and a second non-metal portion 415*e*. In the first metal portion 415*a*, an earphone hole 421, a wired external device connection hole 422, a speaker hole 423, and a mic hole 424 may be formed. In still another example, the second metal portion 415*b* and the third metal portion 415*c* may be positioned at the opposite sides of the first metal portion 415*a*, respectively. In still another example, the first metal portion 415*a* may be split from the second metal portion 415*b* by the non-metal portion 415*d*, and may be split from the third metal portion 415*c* by the second non metal portion 451*e*.

Referring to FIG. 4B, the top side cover 416 is at least partially formed of a metal to be used as a radiator to radiate an RF signal. For example, the top side cover 416 may include a first metal portion 416*a*, a second metal portion 416*b*, a third metal portion 416*c*, a first non-metal portion 416*d*, and a second non-metal portion 416*e*. For example, in the first metal portion 416*a*, a SIM card insertion hole 431 and a mic hole 432 may be formed. According to one embodiment of the present disclosure, the second metal portion 416*b* may be implemented by one metal with the second metal portion 415*b* of the bottom side cover 415*a* and the right side cover 413. The third metal portion 416*c* may be implemented by one metal with the third metal portion 415*c* of the bottom side cover 415 and the left side cover 414. According to another embodiment of the present disclosure, the second metal portion 416*b* may be split from the right side cover 413, and the third metal portion 416*c* may be split from the left side cover 414.

Referring to FIG. 4C, within the housing 410 constituted with the first plate 411, the second plate 412, and the side member 420, a fingerprint sensor 430, a support structure 440 configured to support the first plate 411, a camera 450, a first board 460, a second board 470, a battery 480, and an antenna 490 may be positioned. The fingerprint sensor 430 may be electrically connected to the first board 460 and/or the second board 470, and may be configured to recognize the contact of a fingerprint on a home key 411*a* of the first plate 411 and to generate and output fingerprint data. For example, the fingerprint sensor 430 may output the fingerprint data to a processor (e.g., an AP) mounted on the first board 460. The camera 450 is mounted on the first board 460 to be exposed through a hole 412*a* formed in the second plate 412. The first board 460 may be positioned adjacent to the top side cover 416, and may be electrically connected to the top side cover 416. The second board 470 may be positioned adjacent to the bottom side cover 415, and may be electrically connected to the bottom side cover 4150. The antenna 490 may include a plurality of coil antennas for payment, and may be electrically connected to communication modules (e.g., an NFC module 228) that are mounted on a board (e.g., the first board 460 or the second board 470.

Figure 5:
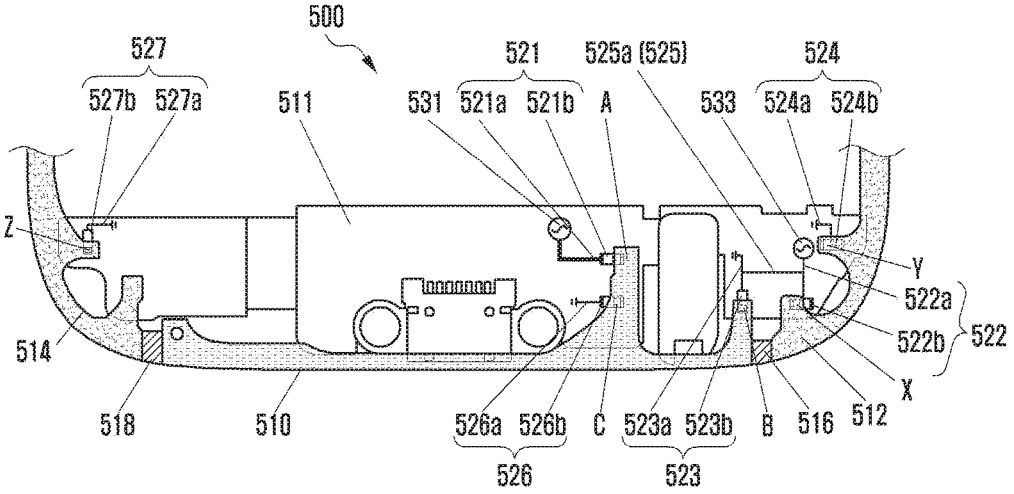
FIG. 5 is a view illustrating a structure of an antenna device according to various embodiments of the present disclosure.

FIG. 5 illustrates a structure of an antenna device according to various embodiments of the present disclosure.

Referring to FIG. 5, the antenna device 500 may have a configuration of an electronic device (e.g., the electronic device 101), and may include a first radiator 510, a second radiator 512, a third radiator 514, a first split portion 516, and a split portion 518.

According to various embodiments of the present disclosure, the first radiator 510, the second radiator 512, and/or the third radiator 514 may have configurations of the above-described first metal portion 415*a* or 416*a*, the second metal portion 415*b* or 416*b*, and the third metal portion 415*c* or 416*c*, respectively. For example, the first split portion 516 may be constituted with the first non-metal portion 415*d* or 416*d*. For example, the second split portion 518 may be constituted with the second non-metal portion 415*e* or 416*e*.

According to various embodiments of the present disclosure, a board 511 configured to provide an electric signal to the radiators 510, 512, and 514 may be included within the electronic device. The board 511 may be implemented using at least one of a printed circuit board (PCB) and flexible PCB (FPCB).

According to various embodiments of the present disclosure, a connection unit may be mounted on the board 511 (e.g., the first board 460 or the second board 470) so as to feed a current to the radiators 510, 512, and 514, and to receive a current from the radiators 510, 512, and 514. In still another example, the board 511 may operate as a ground plate that is capable of grounding the radiators 510, 512, and 514, and a connection unit may be mounted on the board 511 so as to allow the board 511 to operate as the ground plate. For example, the connection unit may include at least one of a contact terminal (e.g., an elastic pin (e.g., a C-clip)), a solder pad, and a conducting line.

According to various embodiments of the present disclosure, a first connection unit 521 may electrically connect a first current source 531 to a first point A of the first radiator 510. For example, the first connection unit 521 may include a signal line 521*a* and/or a contact terminal 521*b*.

According to various embodiments of the present disclosure, a second connection unit 522 may electrically connect a second current source 533 to a first point X of the second radiator 512. For example, the second connection unit 522 may include a signal line 522*a* and a contact terminal 522*b*.

According to various embodiments of the present disclosure, a third connection unit 523 may electrically connect a ground of the board 511 to a second point B of the first radiator 510. For example, the third connection unit 523 may include a signal line 523*a* and a contact terminal 523*b*. For example, the second point B of the first radiator 510 may be positioned between the first point A and the first split portion 516 of the first radiator 510.

According to various embodiments of the present disclosure, a fourth connection unit 524 may electrically connect the ground of the board 511 to a second point Y of the second radiator 512. For example, the fourth connection unit 524 may include a signal line 524*a* and a contact terminal 524*b*. The first point X of the second radiator 512 may be positioned between the second point Y and the first split portion 516 of the second radiator 512.

According to various embodiments of the present disclosure, a fifth connection unit 525 may electrically interconnect the second connection unit 521 and the third connection unit 523. For example, the fifth connection unit 525 may include a signal line 525*a*. The signal line 525*a* may electrically interconnect, for example, any one point of the signal line 522*a* and any one point of the signal line 523*a*.

According to various embodiments of the present disclosure, in a case where a current is output from the second current source 533, a first resonance path, which ends at the ground via the first split portion 516 and the third connection unit 523, and a second resonance path, which ends at the ground via the fourth connection unit 624, may be formed. In addition, a resonance path may additionally be formed by the fifth connection unit 525. For example, when a current is output from the second current source 533, a third resonance path, which ends at the ground via the fifth split portion 525 and the third connection unit 523, may be formed. In addition, when a current is output from the second current source 533, a fourth resonance path, which ends at the ground via the fifth connection unit 525, the first split portion 516, and the fourth connection unit 524, may be formed.

According to various embodiments of the present disclosure, when a current is output from the second current source 533 in a state where the fifth connection unit 525 is omitted, a first RF signal may be radiated by the first resonance path and the second resonance path. When a current is output from the second current source 533 in a state where the fifth connection unit 525 is added, a second RF signal may be radiated by the first to fourth resonance paths. There may be a difference in radiating efficiency between the first RF signal and the second RF signal. For example, the first RF signal may exhibit a radiating efficiency that is lower than a standard (e.g., −10 dB) in a frequency band that is lower than 2000 MHz, and may exhibit a radiating efficiency that exceeds the standard in a frequency band that is higher than 2000 MHz. The second RF signal may exhibit a radiating efficiency that exceeds the standard in a frequency band that is equal to, or higher than, 1500 MHz.

According to various embodiments of the present disclosure, a sixth connection unit 526 may electrically connect the ground of the board 511 to a third point C of the first radiator 510. For example, the sixth connection unit 526 may include a signal line 526*a* and a contact terminal 526*b*. Here, the third point C of the first radiator 510 may be positioned between the first point A and the second point B of the first radiator 510.

According to various embodiments of the present disclosure, a seventh connection unit 527 may electrically connect the ground of the board 511 to a first point Z of the third radiator 514. For example, the seventh connection unit 527 may include a signal line 527*a* and a contact terminal 527*b*.

According to various embodiments of the present disclosure, when a current is output from the first current source 531, a fifth resonance path, which ends at the ground via the second split portion 518 and the seventh connection unit 527, a sixth resonance path, which ends at the ground via the sixth connection unit 526, and a seventh resonance path, which ends at the ground via the third connection unit 523, may be formed.

Figure 6A:
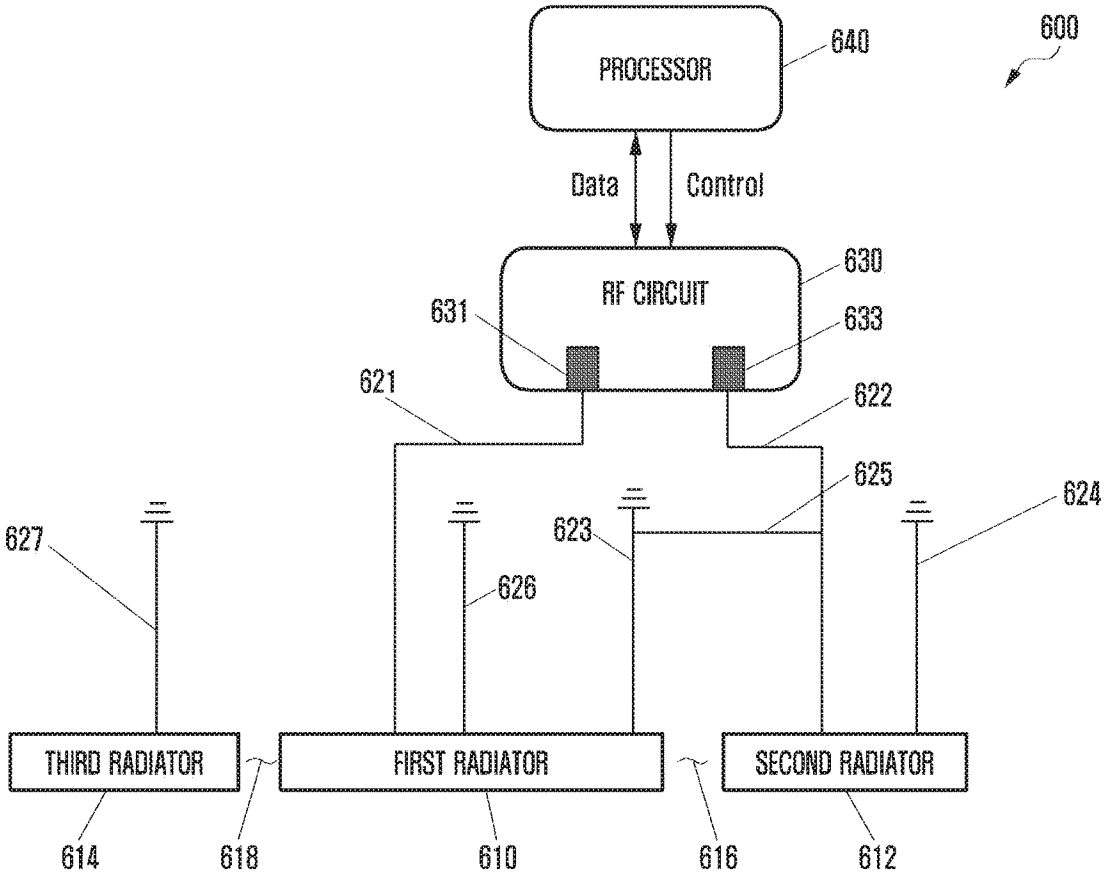
FIG. 6A is a block diagram illustrating an electric configuration of an electronic device according to various embodiments of the present disclosure.
Figure 6B:
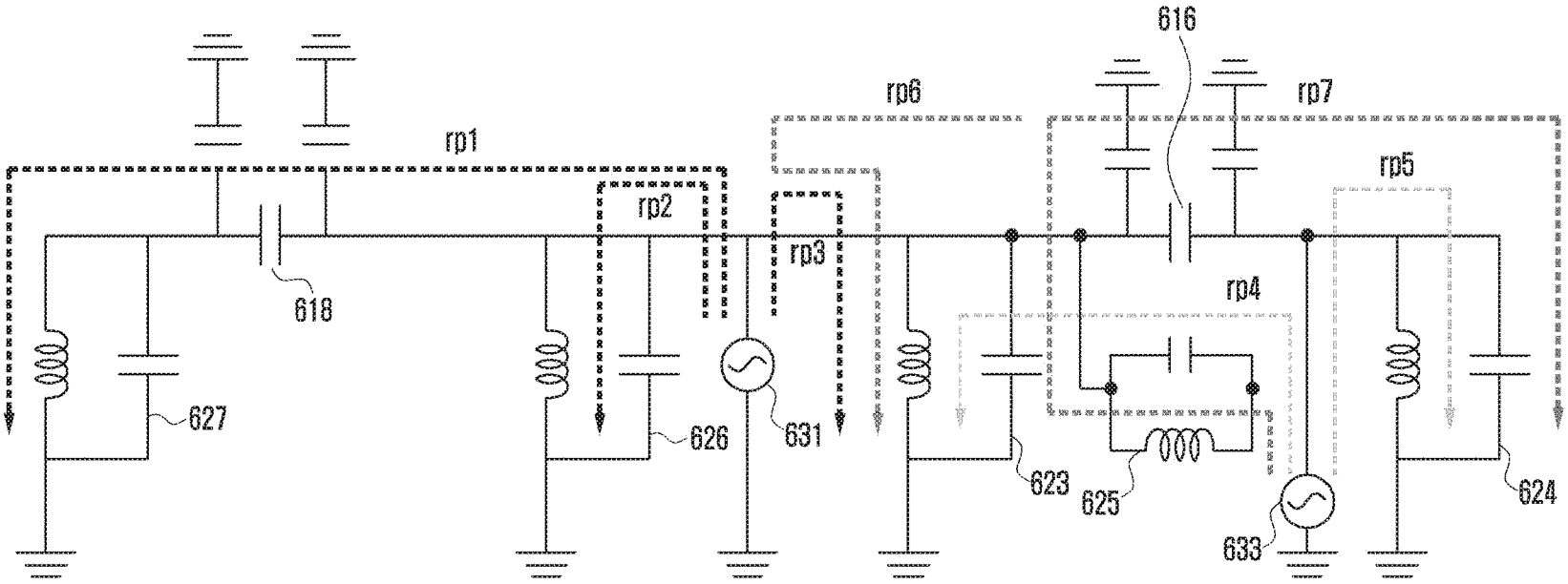
FIG. 6B is a view illustrating the configuration of FIG. 6A with an equivalent circuit according to various embodiments of the present disclosure.
Figure 6C:
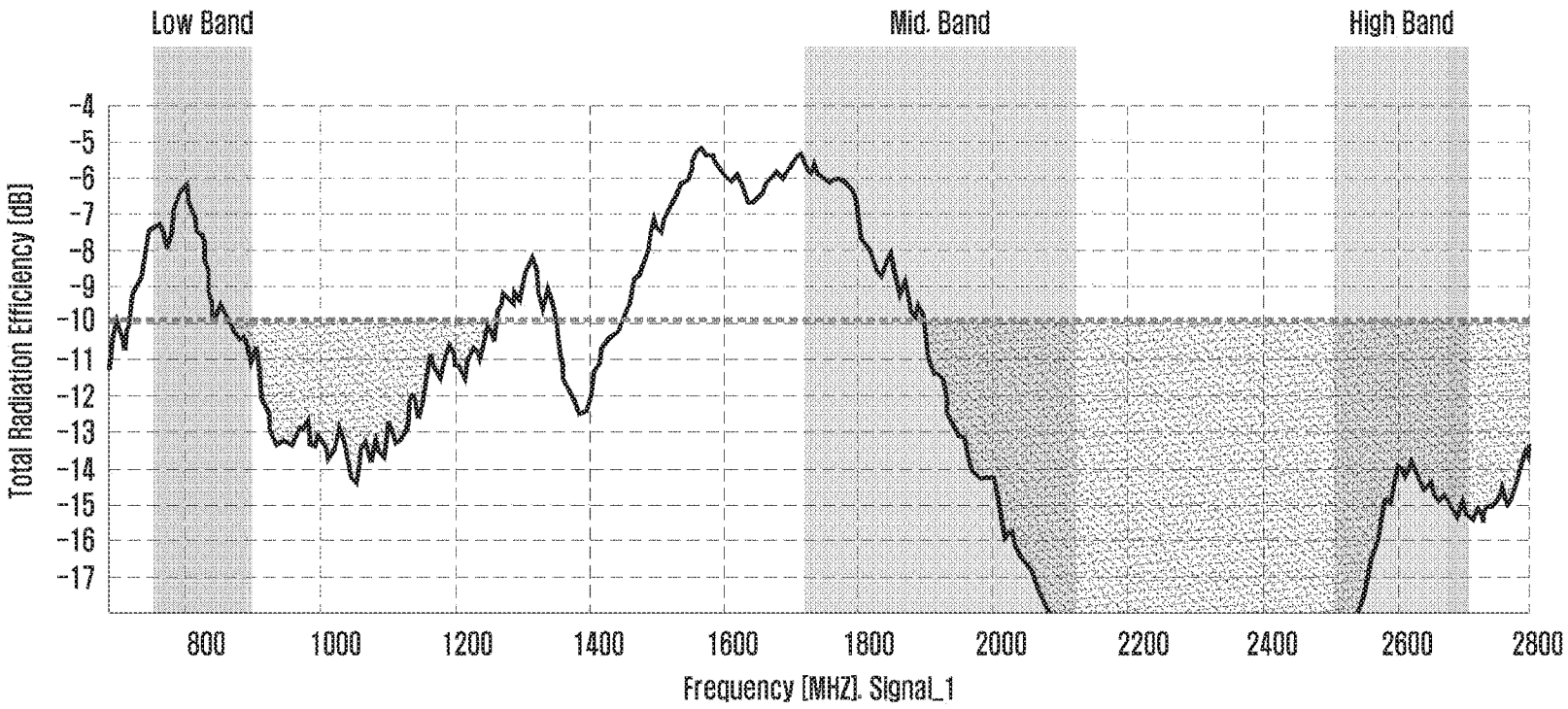
FIGS. 6C and 6D are graphs representing frequency characteristics that may be formed in the electronic device of FIG. 6A according to various embodiments of the present disclosure.
Figure 6D:
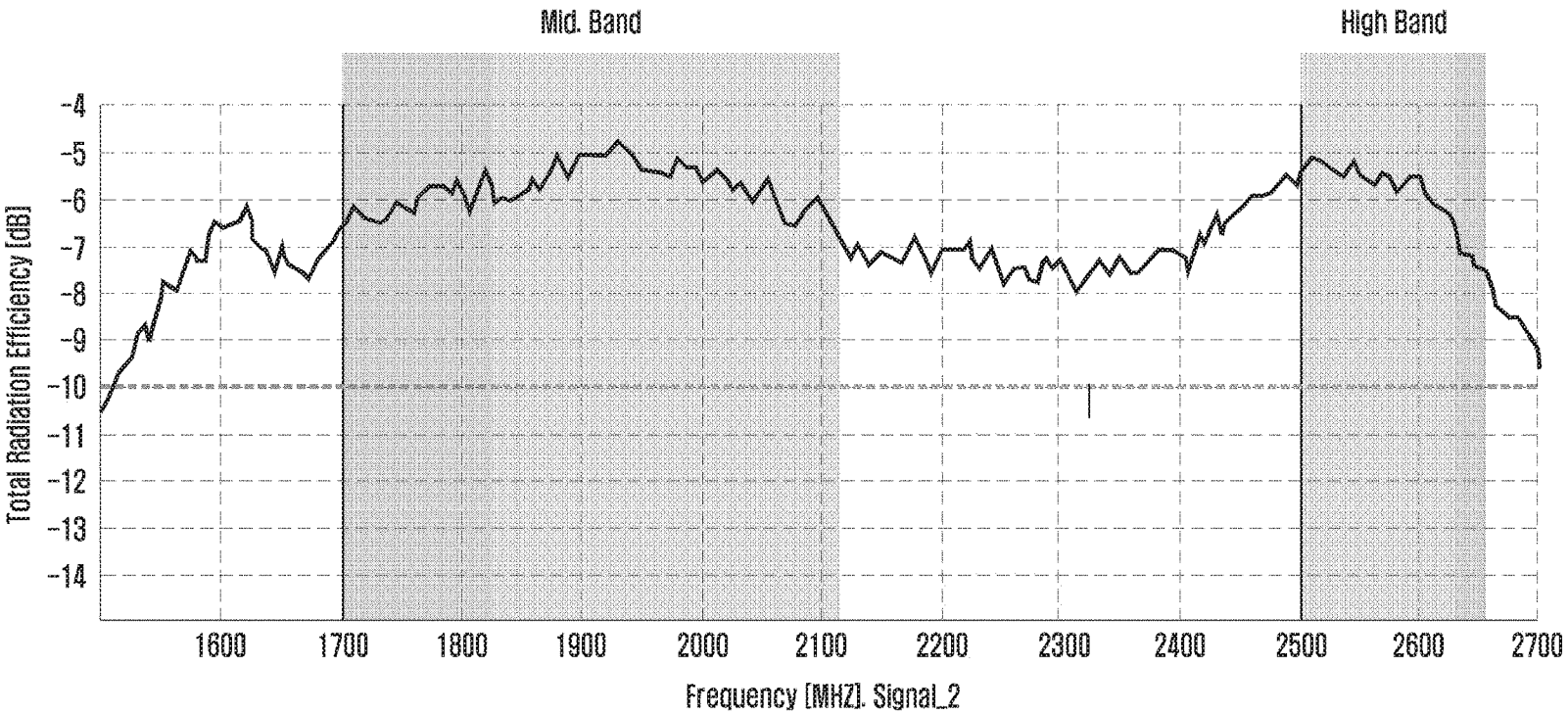

FIG. 6A is a block diagram illustrating an electric configuration of an electronic device according to various embodiments of the present disclosure, FIG. 6B is a view illustrating the configuration of FIG. 6A with an equivalent circuit according to various embodiments of the present disclosure, and FIGS. 6C and 6D are graphs representing frequency characteristics that may be formed in the electronic device of FIG. 6A according to various embodiments of the present disclosure.

Referring to FIG. 6A, an electronic device 600 may have, for example, a configuration of the electronic device 101, and may include a first radiator 610, a second radiator 612, a third radiator 614, a plurality of connection units 621 to 627, an RF circuit 630, and/or a processor 640.

According to various embodiments of the present disclosure, the first radiator 610, the second radiator 612, and/or third radiator 614 may have configurations of the above-described first radiator 510, second radiator 512, and/or the third radiator 514, respectively. For example, the first radiator 610, the second radiator 612, and/or the third radiator 614 may be spatially separated from each other. For example, a first gap 616 may be formed between the first radiator 610 and the second radiator 612, and a second gap 618 may be formed between the first radiator 610 and the third radiator 614. The first gap 616 and the second gap 618 may be formed of a dielectric material. For example, the first gap 616 may be constituted with the first non-metal portion 415*d* or 416*d*, and the second gap 618 may be constituted with the second non-metal portion 415*e* or 416*e*.

According to various embodiments of the present disclosure, the connection units 621 to 627, which are expressed in a manner of depicting a circuit, may correspond to the above-described connection units 521 to 527, respectively. The electric lengths of the connection units 621 to 627 may determine the frequency characteristics of the RF signals radiated from the electronic device 600.

According to various embodiments of the present disclosure, the RF circuit 630 converts data received from the processor 640 into an RF signal, and may have a plurality of terminals. For example, the RF circuit 630 may be constituted with an RF module 229, and may output the first RF signal of the first frequency band (e.g., 700 to 900 MHz, 1700 to 2000 MHz) to the first connection unit 621 through the first terminal 631. In still another example, the RF circuit 630 may output the second RF signal of the second frequency band (e.g., 1700 to 2700 MHz, GPS frequency band) to the second connection unit 622 through the second terminal 633.

The processor 640 is configured to control the communication and power feeding of the RF circuit 630, and may be constituted with a cellular module 221 or a processor 210.

Referring to FIG. 6B, the first terminal 631 and the second terminal 633 may be referred to as a current source in the viewpoint of a circuit. The current source may be electrically connected with a ground GND. Accordingly, the current output from the current source may flow to the ground GND through a radiator. Such a current flow may form a resonance path that has a predetermined resonance frequency.

According to various embodiments of the present disclosure, the first gap 616 and the second gap 618 may be referred to as a coupling capacitance. In still another example, an RF signal may be radiated from the first gap 616 and/or the second gap 618. Accordingly, the opposite ends of each gap may be expressed as being electrically connected to the ground GND through the capacitance (C).

According to various embodiments of the present disclosure, each of the third connection unit 623 and the sixth connection unit 626 may electrically interconnect the first radiator 610 to the ground GND. In still another example, the fourth connection unit 624 may electrically connect the second radiator 612 to the ground GND. In still another example, the seventh connection unit 627 may electrically connect the third radiator 614 to the ground GND. In still another example, the fifth connection unit 625 may electrically interconnect the second connection unit 622 and the third connection unit 623. Accordingly, the connection units 623 to 627 may be regarded as forming a resonance path, and may expressed as L (inductor) and C (capacitor) which are in parallel with each other.

According to various embodiments of the present disclosure, when a current is output from the first terminal 631, a plurality of resonance paths may be formed in the electronic device 600. For example, a first resonance path rp1, which starts from the first terminal 631 and ends at the ground GND via the second gap 618 and the seventh connection unit 627, may be formed. In still another example, a second resonance path rp2, which starts from the first terminal 631 and ends at ground GND via the sixth connection unit 626, may be formed. In still another example, a third resonance path rp3, which starts from the first terminal 631 and ends at the ground GND via the third connection unit 623, may be formed. By the resonance paths rp1 to rp3, the first RF signal may be radiated from the electronic device 600. The radiating efficiency of the first RF signal may be measured, as in FIG. 6C.

Referring to FIG. 6C, When the frequencies of the first RF signals radiated from the electronic device 600 by the resonance paths rp1, rp2, and rp3 are in the bands of approximately 700 to 900 MHz, 1300 MHz, and 1500 to 1900 MHz, respectively, the radiating efficiency larger than the standard (e.g., −10 dB) can be secured.

According to various embodiments of the present disclosure, when a current is output from the second terminal 633, a plurality of resonance paths may be formed in the electronic device 600. For example, a fourth resonance path rp4, which starts from the second terminal 633 and ends at the ground GND via the first gap 616 and the third connection unit 623, may be formed. In still another example, a fifth resonance path rp5, which starts from the second terminal 633 and ends at the ground GND via the fourth connection unit 624, may be formed. In still another example, a sixth resonance path rp6, which starts from the second terminal 633 and ends at the ground GND via the fifth connection unit 625 and the third connection unit 623, may be formed. In still another example, a sixth seventh path rp7, which starts from the second terminal 633 and ends at the ground GND via the fifth connection unit 625, the first gap 616, and the fourth connection unit 624, may be formed. By the resonance paths rp4 to rp7, second RF signals may be radiated from the electronic device 600. The radiating efficiency of the RF signal may be measured as in FIG. 6D. Referring to FIG. 6D, when the frequencies of the second RF signals radiated from the electronic device 600 by the resonance paths rp4, rp5, rp6, and rp7 are in the band of approximately 1500 to 2700 MHz, the radiating efficiency larger than the standard (e.g., −10 dB) can be secured.

Upon comparing FIGS. 6C and 6D, it can be seen that the resonance paths rp4 to rp7 includes a part of the frequency band of the rp1 to rp3 (i.e., 1500 to 1900 MHz). Accordingly, stable RF communication can be performed in the frequency band of 1500 MHz or higher only with the output of the first RF signal from the second terminal 633 without the output of an RF signal to the first terminal 631.

According to a certain embodiment of the present disclosure, when the output of the first RF signal is not needed, the first connection unit 621, the sixth connection unit 626, the seventh connection unit 627, and the third radiator 614 may be omitted from the electric configuration of FIG. 6A.

Figure 7:
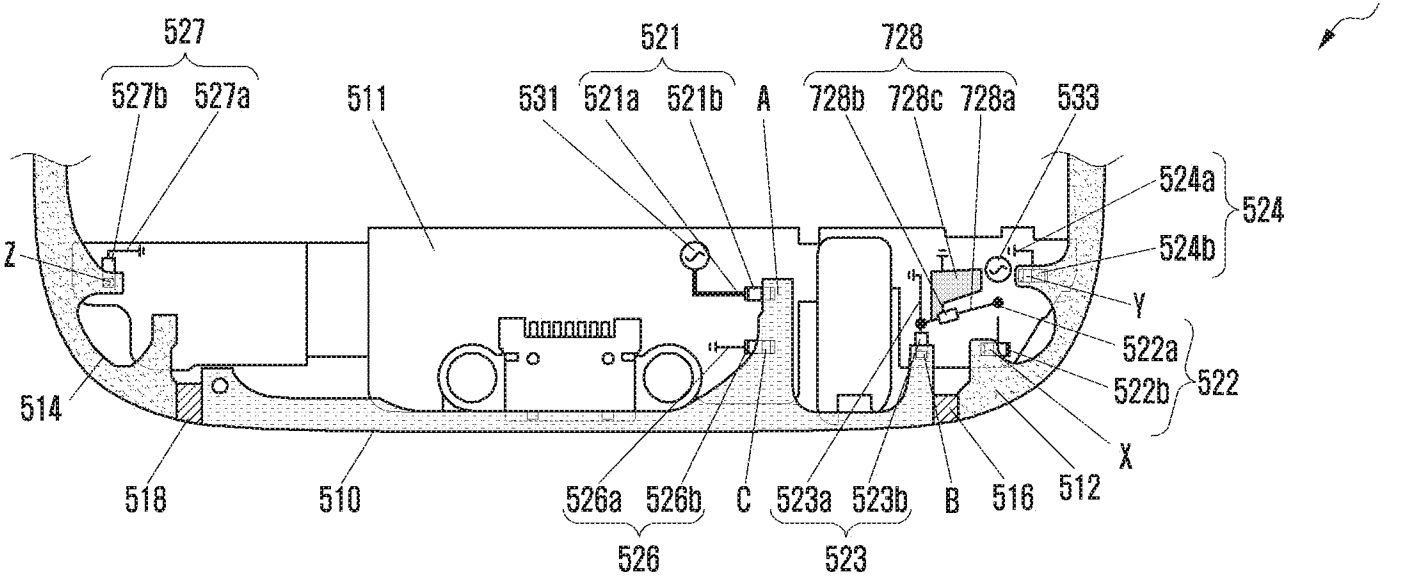
FIG. 7 is a view illustrating a structure of an antenna device according to various embodiments of the present disclosure.

FIG. 7 illustrates a structure of an antenna device according to various embodiments of the present disclosure.

Referring to FIG. 7, the electronic device 700 may be the same configuration as the electronic device 500 illustrated in FIG. 5. However, the antenna device 700 may include an eighth connection unit 728 instead of the fifth connection unit 525. Referring to FIG. 7, the antenna device 700 may have a configuration of an electronic device (e.g., the electronic device 101).

According to various embodiments of the present disclosure, an eighth connection unit 728 is a configuration to electrically interconnect the second connection unit 521 and the third connection unit 523, and may be mounted on the board 511. For example, the eighth connection unit 728 may include a signal line 728*a*, a tuning circuit 728*b*, and/or a metal plate 728*c*. The signal line 728*a* may electrically connect any one point of the signal line 522*a* and to the tuning circuit 728*b* and the metal plate 728*c*. For example, in the tuning circuit 728*b*, the first electrode may be electrically connected with the signal line 728*a*, and the second electrode may be electrically connected with any one point of the signal line 523*a*. For example, the metal plate 728*c* may be electrically connected to the second electrode of the tuning circuit 728*b*.

According to various embodiments of the present disclosure, when the tuning circuit 728*b* is configured as a passive element, an inductor, or a capacitor, a physical or electric characteristic can be determined. For example, the characteristic of the tuning circuit 728*b* may be determined by the capacitance formed between the metal plate 728*c* and the signal line 728*a*. In still another example, the tuning circuit 728*b* may include a switch. For example, in the case where the tuning circuit 728*b* includes a switch, a processor (e.g., the processor 120) may control the switch so as to adjust the characteristic of the tuning circuit 728*b*. Due to the change of the characteristic of the tuning circuit 728*b*, the frequency characteristic may be adjusted.

In still another example, the adjustment of the frequency characteristic may also be implemented through the regulation of at least one of the shape and the size of the metal plate 728*c*. For example, a gap may be formed between the metal plate 728*c* and the signal line 728*a*, and the frequency characteristic can be adjusted by physically regulating the shape of the gap. In still another example, by deforming the shape of the metal plate 728*c*, the frequency characteristic can be adjusted. In still another example, by regulating the physical spacing between the metal plate 728*c* and the signal line 728*a*, the frequency characteristic can be adjusted.

According to various embodiments of the present disclosure, as compared with the antenna device 500 of FIG. 5, the electronic device 700 may be additionally formed with a resonance path. For example, when a current is output from the second current source 533, a first resonance path, which ends at the ground via the first split portion 516 and the third connection unit 523, and a second resonance path, which ends at the ground via the fourth connection unit 624, may be formed. In addition, a resonance path may be additionally formed by the eighth connection unit 728. For example, when a current is output from the second current source 533, a third resonance path, which ends at the ground via the signal line 728*a*, the tuning circuit 728*b*, and the third connection unit 523, and a fourth resonance path, which ends at the ground via the signal line 728*a*, the tuning circuit 728*b*, the first split portion 516, and the fourth connection unit 524, may be formed. In addition, as compared with the antenna device 500 of FIG. 5, a fifth resonance path, which ends at the ground via the signal line 728*a*, the tuning circuit 728*b*, and the metal plate 728*c*, may be additionally formed.

According to various embodiments of the present disclosure, in the antenna device 500 of FIG. 5, the first RF signal may be radiated by the first to fourth resonance paths. In the antenna device 700 of FIGS. 8A to 8C, the second RF signal may be radiated by the first to fourth resonance paths and the fifth resonance path. There may be a difference in radiating efficiency between the first RF signal and the second RF signal. For example, as compared with the first RF signal, the second RF signal may have a lower radiating unit efficiency in a lower frequency band (e.g., 1600 MHz), but may be a higher radiating efficiency in a higher frequency band (e.g., 2500 MHz).

Figure 8A:
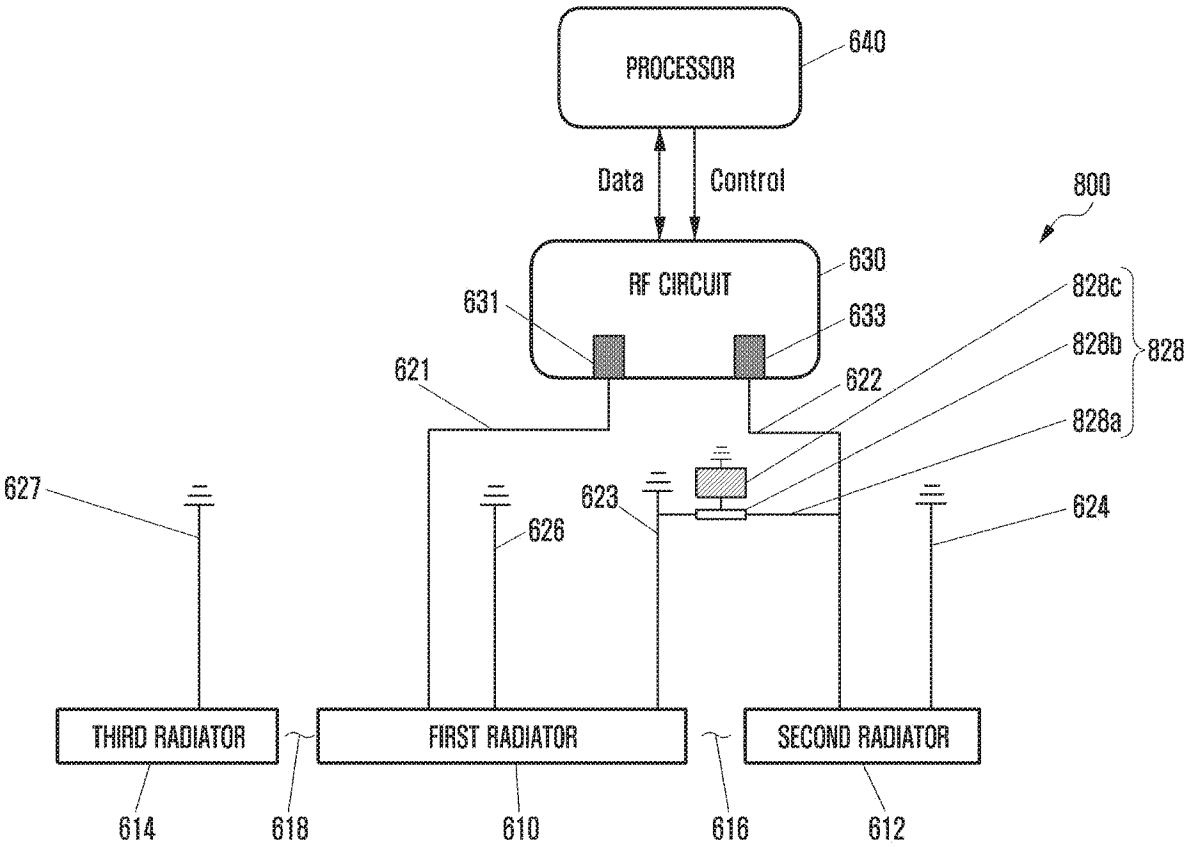
FIG. 8A is a block diagram illustrating an electric configuration of an electronic device according to various embodiments of the present disclosure.
Figure 8B:
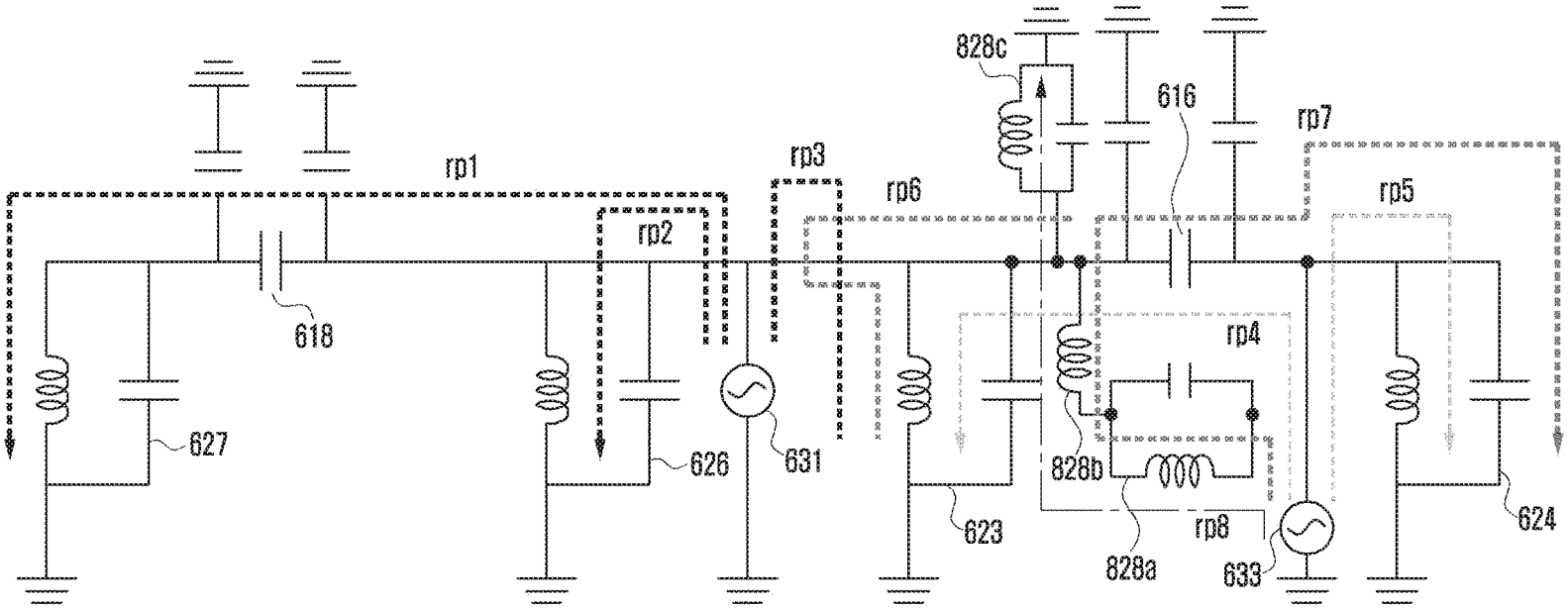
FIG. 8B is a view illustrating the configuration of FIG. 8A with an equivalent circuit according to various embodiments of the present disclosure.
Figure 8C:
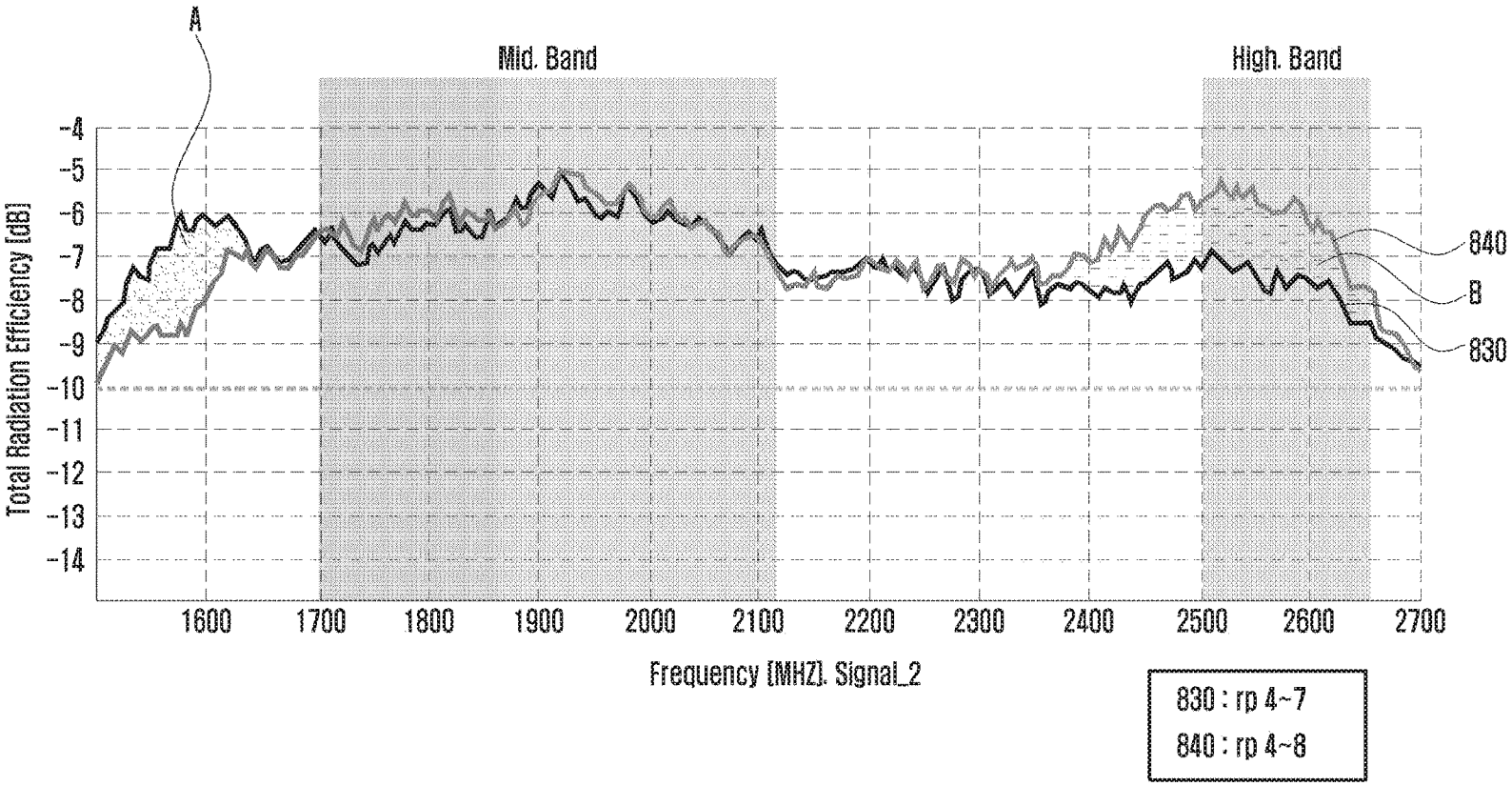
FIG. 8C is a graph representing frequency characteristics that may be formed in the electronic device of FIG. 8A according to various embodiments of the present disclosure.

FIG. 8A is a block diagram illustrating an electric configuration of an electronic device according to various embodiments of the present disclosure, FIG. 8B is a view illustrating the configuration of FIG. 8A with an equivalent circuit according to various embodiments of the present disclosure, and FIG. 8C is a graph representing frequency characteristics that may be formed in the electronic device of FIG. 8A according to various embodiments of the present disclosure.

Referring to FIG. 8A, the electronic device 800 may be the same configuration as the electronic device 600 illustrated in FIG. 6A. However, the antenna device 800 may include an eighth connection unit 828, instead of the fifth connection unit 625.

According to various embodiments of the present disclosure, the eighth connection unit 828 may include a signal line 828*a*, a tuning circuit 828*b*, and/or a metal plate 828*c*. For example, the eighth connection unit 828, which is expressed in a viewpoint of circuit, may correspond to the above-described eighth connection unit 728 of FIG. 7. For example, when the configuration of the eighth connection unit 828 is expressed with an equivalent circuit, as illustrated in FIG. 8B, each of the signal line 828*a* and the metal plate 828*c* may be respectively expressed as L (inductor) and C (capacitor), which are in parallel with each other. The tuning circuit 828*b* may be expressed as L (inductor).

Referring to FIG. 8B, when a current is output from the first terminal 631, resonance paths rp1 to rp3, which are the same as those of FIG. 6B, may be formed in the electronic device 800. Accordingly, by the resonance paths rp1 to rp3, the first RF signal may be radiated from the electronic device 800.

According to various embodiments of the present disclosure, when a current is output from the second terminal 633, resonance paths rp4 to rp7 may be formed in the electronic device 800 to be equal to, or at least partially similarly to, those of FIG. 6B. In addition, an eighth resonance path rp8, which starts from second terminal 633 and ends at the ground via the signal line 828*a*, the tuning circuit 828*b*, and the metal plate 828*c*, may be additionally formed. Accordingly, by the resonance paths rp4 to rp7 and the resonance path rp8, the second RF signal may be radiated from the electronic device 800.

Referring to FIG. 8C, when the second RF signal is radiated by the resonance paths rp4 to rp7, the radiating efficiency of the second RF signal may be measured as in graph 830. Meanwhile, when the second RF signal is radiated by the resonance paths rp4 to rp7 and resonance path rp8, the radiating efficiency of the second RF signal may be measured as in graph 840.

Upon comparing two graphs, since rp8 and another resonance path interfere with each other, the radiating efficiency may be lowered in the lower frequency band (e.g., 1600 MHz) (A), and the radiating efficiency may be enhanced in the higher frequency band (e.g., 2500 MHz) (B).

According to a certain embodiment of the present disclosure, when the output of the first RF signal is not needed, the first connection unit 621, the sixth connection unit 626, the seventh connection unit 627, and the third radiator 614 may be omitted from the electric configuration of FIG. 8A.

Figure 9:
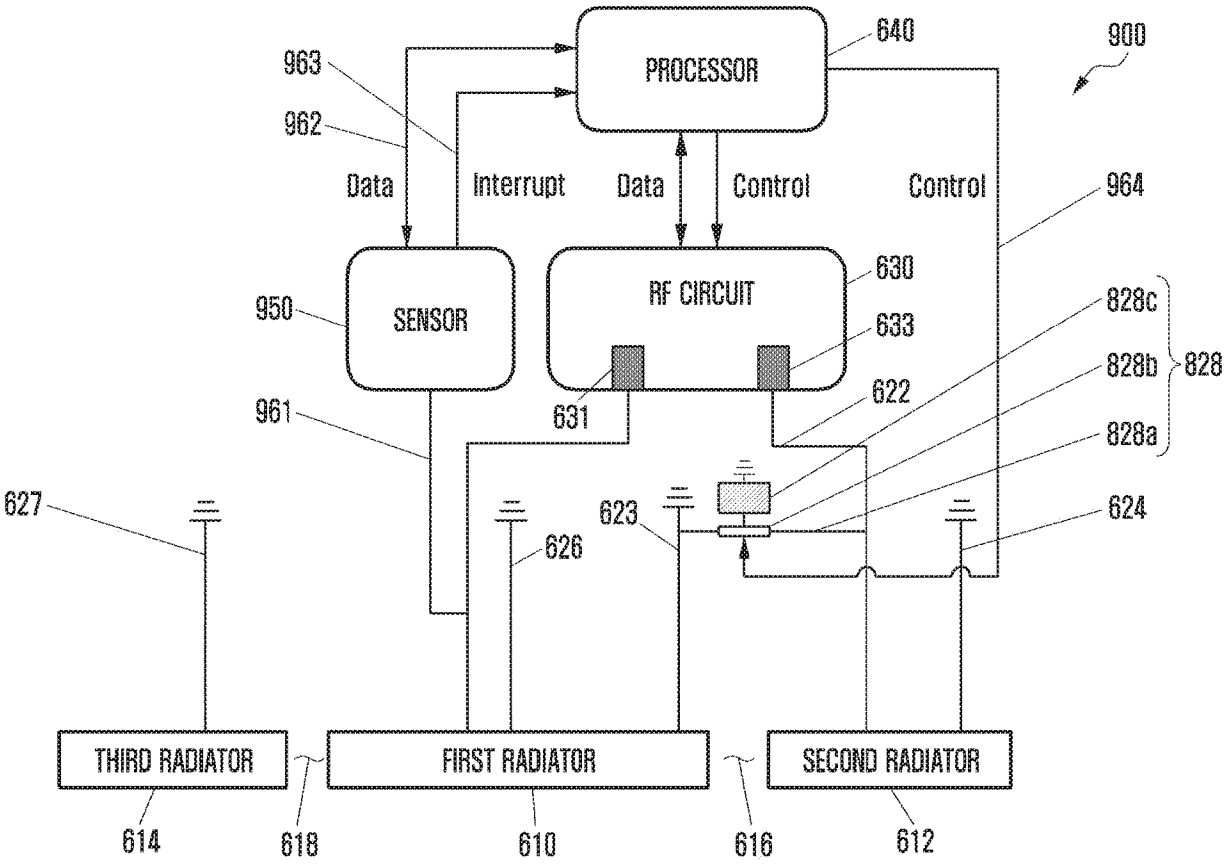
FIG. 9 is a block diagram illustrating an electric configuration of an electronic device according to various embodiments of the present disclosure.

FIG. 9 is a block diagram illustrating an electric configuration of an electronic device according to various embodiments of the present disclosure.

Referring to FIG. 9, the electronic device 900 may be the same configuration as the electronic device 800 illustrated in FIGS. 8A to 8C according to various embodiments of the present disclosure. Accordingly, resonance paths rp4 to rp7 and rp8 may be formed in the electronic device 900 equally to, or at least partially similarly to, the electronic device 800.

According to various embodiments of the present disclosure, the electronic device 900 may further include at least one sensor 950. For example, the sensor 950 may be electrically connected to a radiator (e.g., the first radiator 610) via a sensing line 961 so as to detect a physical amount (e.g., capacitance). For example, in the case where the detected physical amount (or a variation thereof) does not satisfy a designated requirement (e.g., larger or less than a numerical value of the designated requirement), the sensor 950 may transmit an interrupt signal to the processor 640 through an interrupt line 963. For example, when a human body comes in contact with a gap (e.g., the second gap 618) so that the coupling capacitance is less than a standard value, an interrupt signal may be generated. In addition, the sensor 950 may transmit data corresponding to the detected physical amount (or a variation thereof) to the processor 640 through a data line 962.

According to various embodiments of the present disclosure, in response to the interrupt, the processor 640 may stop an operation (e.g., data communication), and may determine whether the radiating performance is deteriorated based on the data received from the sensor 950. For example, when it is determined that the radiating performance is deteriorated (e.g., when it is determined that the radiating efficiency of an RF signal is inferior to a standard value (e.g., −10 dB) in a specific band), the processor 640 may compensate for the deterioration of the radiating performance caused by the contact of the human body by regulating an electric characteristic of the tuning circuit 828*b* through a control line 964. For example, the processor 640 controls a switch of the tuning circuit 828*b* so as to adjust the electric length of resonance paths (e.g., resonance paths rp6, rp7 and rp8 that pass through the tuning circuit 828*b*). An adjustment of a resonance length or an adjustment of a gain may be performed per each switch port depending on a difference in a ground line or a signal line or an impedance matching value.

According to a certain embodiment of the present disclosure, the first connection unit 621, the sixth connection unit 626, the seventh connection unit 627, and the third radiator 614 may be omitted from the electric configuration of FIG. 9. For example, in the case where the output of the first RF signal is not needed, the sixth connection unit 626, the seventh connection unit 627, and the third radiator 614 may be omitted.

Figure 10:
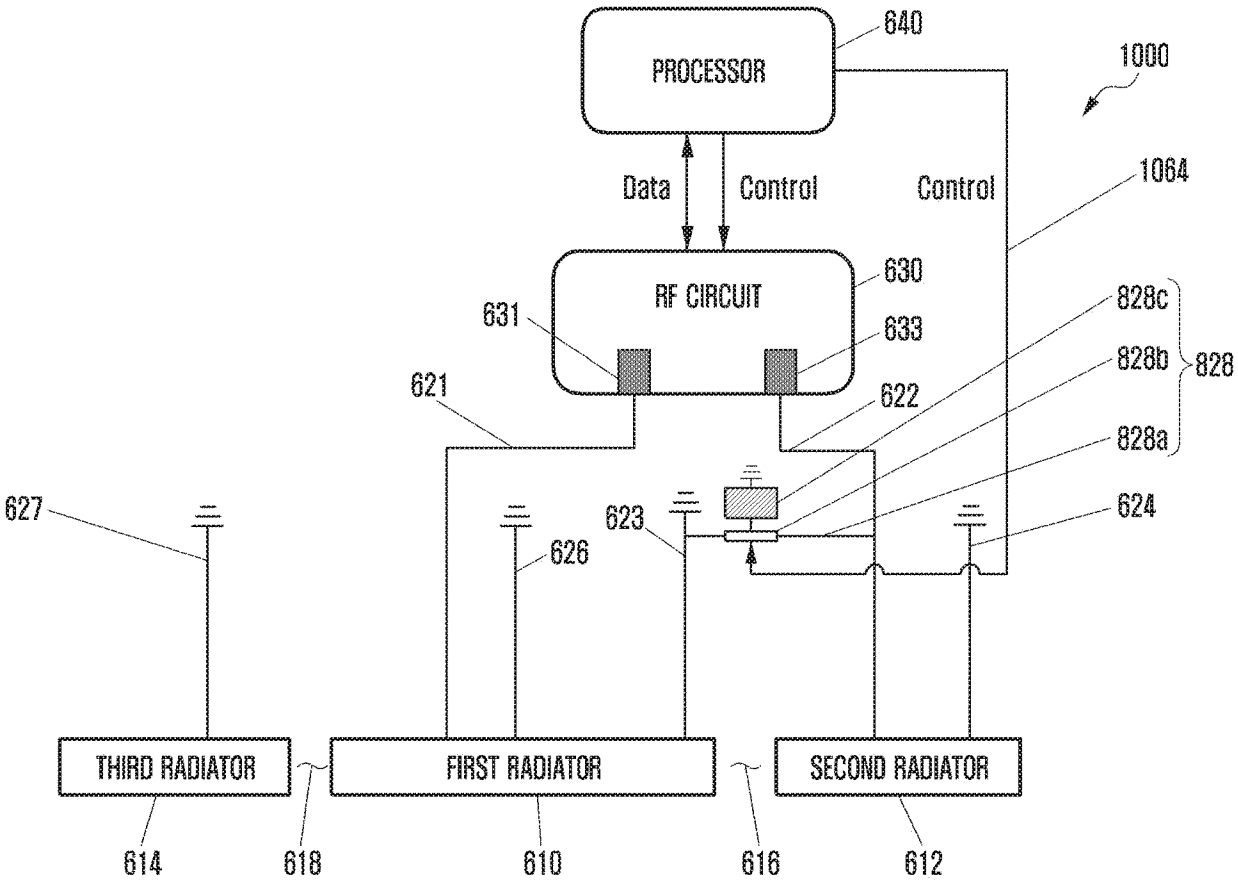
FIG. 10 is a block diagram illustrating an electric configuration of an electronic device according to various embodiments of the present disclosure.

FIG. 10 is a block diagram illustrating an electric configuration of an electronic device according to various embodiments of the present disclosure.

Referring to FIG. 10, the electronic device 1000 may be the same configuration as the electronic device 800 illustrated in FIGS. 8A to 8C. For example, resonance paths rp4 to rp7 and rp8 may be formed in the electronic device 1000 equally to, or at least partially similarly to, the electronic device 800.

In the case where the output of the first RF signal is not needed, the processor 640 may receive data related to the frequency characteristic of an RF signal from the RF circuit 630, and may determine whether the radiating performance is deteriorated based on the received data. When it is determined that the radiating performance is deteriorated (e.g., when it is determined that the radiating efficiency of an RF signal is inferior to a standard value (e.g., −10 dB) in a specific band), the processor 640 may compensate for the deterioration of the radiating performance caused by the contact of the human body by regulating an electric characteristic of the tuning circuit 828*b* through a control line 1064.

According to a certain embodiment of the present disclosure, the first connection unit 621, the sixth connection unit 626, the seventh connection unit 627, and the third radiator 614 may be omitted from the electric configuration of FIG. 10. For example, in the case where the output of the first RF signal is not needed, the sixth connection unit 626, the seventh connection unit 627, and the third radiator 614 may be omitted.

Figure 11:
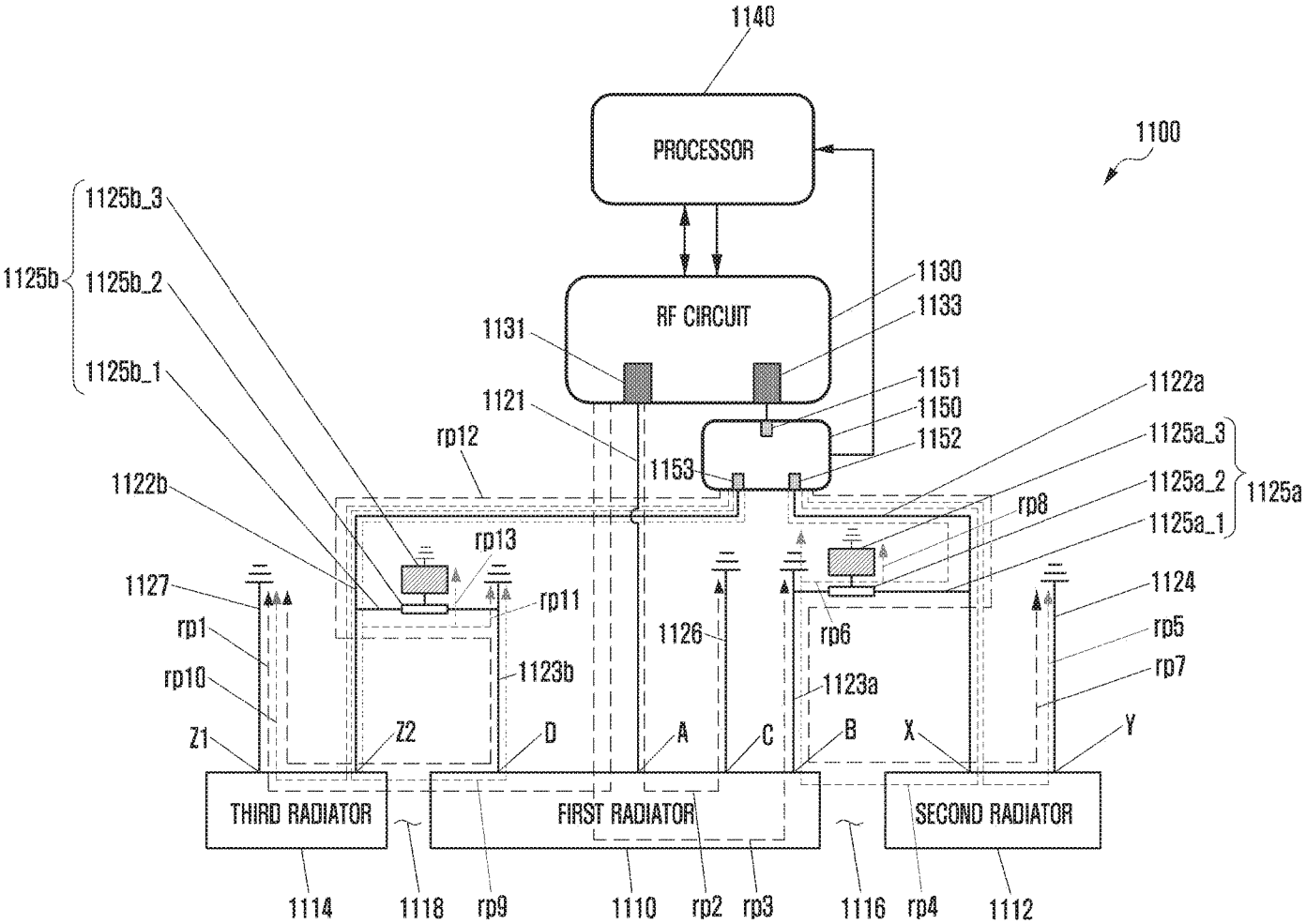
FIG. 11 is a block diagram illustrating an electric configuration of an electronic device according to various embodiments of the present disclosure.

FIG. 11 is a block diagram illustrating an electric configuration of an electronic device according to various embodiments of the present disclosure.

Referring to FIG. 11, the antenna device 1100 may have a configuration of, for example, the electronic device 101, and may include a first radiator 1110, a second radiator 1112, a third radiator 1114, a plurality of connection units 1121, 1122*a*, 1122*b*, 1123*a*, 1123*b*, 1124, 1125*a*, 1125*b*, 1126, 1127 that form an electric path, an RF circuit 1130, a processor 1140, and a switch 1150 for selecting a resonance path.

According to various embodiments of the present disclosure, the first radiator 1110, the second radiator 1112, and/or third radiator 1114 may be configured to be the same as, or to be at least partially similar to the configurations of the first radiator 610, the second radiator 612, and the third radiator 614, which are described above-described, respectively. In addition, the second radiator 1112 and the third radiator 1114 may be configured to be symmetric to each other. For example, the two radiators 1112 and 1114 may be equal to each other in shape, size, and material.

According to various embodiments of the present disclosure, the first connection unit 1121 may electrically connect a first terminal 1131 of the RF circuit 1130 to a first point A of the first radiator 1110.

According to various embodiments of the present disclosure, the second connection unit 1122*a* may be electrically connected with the first output port 1152 of the switch 1150. For example, when the input port 1151 of the switch 1150 is electrically connected to the first output port 1152, the second connection unit 1122*a* may be electrically connected with the second terminal 1133 of the RF circuit 1130, and may thus electrically connect the second terminal 1133 to a first point X of the second radiator 1112.

According to various embodiments of the present disclosure, the third connection unit 1123*a* may electrically connect a ground to a second point B of the first radiator 1110. The second point B may be positioned between the first point A and the first split portion 1116.

According to various embodiments of the present disclosure, the fourth connection unit 1124 may electrically connect the ground to a second point Y of the second radiator 1112. The first point X may be positioned between the second point Y and the first split portion 1116.

According to various embodiments of the present disclosure, the fifth connection unit 1125*a* may be configured to be the same as, or at least partially similar to, the eighth connection unit 828 of FIGS. 8A to 8C. For example, the fifth connection unit 1125*a* may include a signal line 1125*a*_1, a tuning circuit 1125*a*_2, and a metal plate 1125*a*_3. For example, the signal line 1125*a*_1 may electrically connect any one point of the second connection unit 1122*a* to the tuning circuit 1125*a*_2 and the metal plate 1125*a*_3. For example, in the tuning circuit 1125*a*_2, the first electrode may be electrically connected with the signal line 1125*a*_1, and the second electrode may be electrically connected with any one point of the third connection unit 1123*a*. For example, the metal plate 1125*a*_1 may be electrically connected to the tuning circuit 1125*a*_1 (e.g., the second electrode).

According to various embodiments of the present disclosure, the sixth connection unit 1126 may electrically connect the ground to a third point C of the first radiator 1110. The third point C may be positioned between the first point A and the second point B.

According to various embodiments of the present disclosure, the seventh connection unit 1127 may electrically connect the ground to a first point Z1 of the third radiator 1114.

According to various embodiments of the present disclosure, the eighth connection unit 1122*b* may be electrically connected with the second output port 1153 of the switch 1150. For example, when the input port 1151 of the switch 1150 is electrically connected to the second output port 1153, the eighth connection unit 1122*b* may be electrically connected with the second terminal 1133 of the RF circuit 1130, and may thus electrically connect the second terminal 1133 to a second point Z2 of the third radiator 1114. The second point Z2 may be positioned between the first point Z1 and the second split portion 1118.

According to various embodiments of the present disclosure, the ninth connection unit 1123*b* may be electrically connected to a fourth point D of the first radiator 1110. The fourth point D may be positioned between the first point A and the second split portion 1118.

According to various embodiments of the present disclosure, the tenth connection unit 1125*b* may be configured to be symmetric to the fifth connection unit 1125*a*. For example, the tenth connection unit 1125*b* may include a signal line 1125*b*_1, a tuning circuit 1125*b*_2, and a metal plate 1125*b*_3. For example, the signal line 1125*b*_1 may electrically connect any one point of the eighth connection unit 1122*b* to the tuning circuit 1125*b*_2 and the metal plate 1125*b*_3. For example, in the tuning circuit 1125*b*_2, the first electrode may be electrically connected with the signal line 1125*b*_1, and the second electrode may be electrically connected with any one point of the ninth connection unit 1123*b*. For example, the metal plate 1125*b*_1 may be electrically connected to the tuning circuit 1125*b*_1 (e.g., the second electrode).

According to various embodiments of the present disclosure, when a current is output from the first terminal 1131, a plurality of resonance paths may be formed in the electronic device 1100. For example, a first resonance path rp1, which starts from the first terminal 1131 and ends at the ground GND via the second gap 1118 and the seventh connection unit 1127, may be formed. In still another example, a second resonance path rp2, which starts from the first terminal 1131 and ends at the ground GND via the sixth connection unit 1126, may be formed. In still another example, a third resonance path rp3, which starts from the first terminal 1131 and ends at the ground GND via the sixth connection unit 1126, may be formed. For example, by the resonance paths rp1 to rp3, the first RF signal may be radiated from the electronic device 1100. According to various embodiments of the present disclosure, the resonance paths rp1 to rp3 may be the same as the resonance paths rp1 to rp3 of FIG. 6B, respectively, and thus, the radiating efficiency of the first RF signal may be measured as in FIG. 6C.

According to various embodiments of the present disclosure, as the switch 1150, for example, a double pole double throw (DPDT) type switch or a single pole double throw (SPDT) type switch may be used, and its operation may be controlled by the processor 1140. For example, the processor 1140 may output a control signal to the switch 1150 so as to perform a first connection operation of electrically connecting the input port 1151 with the first output port 1152 and a second connection operation of electrically connecting the input port 1151 to the second output port 1153. Depending on the first connection operation or the second connection operation, another resonance path may be formed in the electronic device 1100.

For example, when a current is output from the second terminal 1133 and the first connection operation is performed, a fourth resonance path rp4, which starts from the second terminal 1133 and ends at the ground GND via the first gap 1116 and the third connection unit 1123*a*, may be formed. In still another example, a fifth resonance path rp5, which starts from the second terminal 1133 and ends at the ground GND via the fourth connection unit 1124, may be formed. In still another example, a sixth resonance path rp6, which starts from the second terminal 1133 and ends at the ground GND via the signal line 1125*a*_1, the tuning circuit 1125*a*_2, and the third connection unit 1123*a*, may be formed. In still another example, a seventh resonance path rp7, which starts from the second terminal 1133 and ends at the ground GND via the signal line 1125*a*_1, the tuning circuit 1125*a*_2, the first gap 1116, and the fourth connection unit 1124, may be formed. In still another example, an eighth resonance path rp8, which starts from second terminal 1133 and ends at the ground via the signal line 1125*a*_1, the tuning circuit 1125*a*_2, and the metal plate 1125*a*_1, may be additionally formed. By the resonance paths rp4 to rp8, the second RF signal may be radiated from the electronic device 1100. The resonance paths rp4 to rp8 may be the same as the resonance paths rp4 to rp8 of FIG. 8B, respectively, and thus, the radiating efficiency of the second RF signal may be measured as in the graph 840 in FIG. 8C.

According to various embodiments of the present disclosure, for example, when a current is output from the second terminal 1133 and the second connection operation is performed, a ninth resonance path rp9, which starts from the second terminal 1133 and ends at the ground GND via the second gap 1118 and the third connection unit 1123*b*, may be formed. In still another example, a tenth resonance path rp10, which starts from the second terminal 1133 and ends at the ground GND via the seventh connection unit 1127, may be formed. In still another example, an eleventh resonance path rp11, which starts from the second terminal 1133 and ends at the ground GND via the signal line 1125*b*_1, the tuning circuit 1125*b*_2, and the ninth connection unit 1123*b*, may be formed. In still another example, a twelfth resonance path rp12, which starts from the second terminal 1133 and ends at the ground GND via the signal line 1125*b*_1, the tuning circuit 1125*b*_2, the second gap 1118, and the seventh connection unit 1127, may be formed. In still another example, a thirteenth resonance path rp13, which starts from the second terminal 1133 and ends at the ground via the signal line 1125*b*_1, the tuning circuit 1125*b*_2, and the metal plate 1125*b*_1, may be additionally formed. By the resonance paths rp9 to rp13, the second RF signal may be radiated from the electronic device 1100. For example, the resonance paths rp9 to rp13 formed by the connection units 1122*b*, 1123*b*, and 1125*b* may be the same as the resonance paths rp4 to rp8 formed by the connection units 1122*a*, 1122*b*, and 1125*a*, respectively, and the radiating efficiency of the second RF signal radiated due to the resonance paths rp9 to rp13 may be measured as in graph 840 in FIG. 8C.

According to various embodiments of the present disclosure, the processor 1140 may determine whether the radiating performance is deteriorated, and may control the switch 1150 based on the determination result. Here, the radiating performance may be deteriorated due to a contact with a human body. For example, it is assumed that the user holds the electronic device 1100 by a hand. When the user holds the electronic device 1100 by the right hand, the first gap 1116 may come in contact with the user's body. Thus, the radiating efficiency of the second RF signal, which is radiated due to the resonance paths (e.g., rp4, rp6, and rp7) that pass through the first gap 1116, may be less than the standard value (e.g., −10 dB). When the user holds the electronic device 1100 by the left hand, the second gap 1118 may come in contact with the user's body. Thus, the radiating efficiency of the second RF signal, which is radiated due to the resonance paths (e.g., rp9, rp11, and rp12), which pass through the second gap 1118, may be less than the standard value (e.g., −10 dB). In still another example, a sensor (e.g., the sensor 950) may be used for the determination. In still another example, data related to the frequency characteristic of the RF signal received from the RF circuit 1130 may be used.

According to various embodiments of the present disclosure, when it is determined that the radiating performance is deteriorated when the second RF signal is radiated by the resonance routes rp4 to rp8, the processor 1140 may connect the input port 1151 of the switch 1150 to the second output port 1153. In addition, when it is determined that the radiating performance is deteriorated when the second RF signal is radiated by the resonance routes rp9 to rp13, the processor 1140 may connect the input port 1151 of the switch 1150 to the second input port 1151.

According to a certain embodiment of the present disclosure, the fifth connection unit 1125*a* may be replaced by the signal line that connects one point of the second connection unit 1122*a* to one point of the third connection unit 1123*a*. That is, the tuning circuit 1125*a*_2 and the metal plate 1125*a*_3 may be omitted from the configuration. When the fifth connection unit 1125*a* is replaced by a signal line as described above, the second RF signal may be radiated due to the resonance paths rp4 to rp7, and the radiating efficiency thereof may be measured as in graph 830 in FIG. 8C. The tenth connection unit 1125*b* may be replaced by the signal line that connects one point of the eighth connection unit 1122*b* to one point of the ninth connection unit 1123*b*. When the tenth connection unit 1125*b* is replaced by the signal line as described above, the second RF signal may be radiated due to the resonance paths rp9 to rp12, and the radiating efficiency thereof may be measured as in graph 830 in FIG. 8C.

According to a certain embodiment of the present disclosure, when the output of the first RF signal is not needed, the first connection unit 1121 and the sixth connection unit 1126 may be omitted from the electric configuration of FIG. 11.

Figure 12:
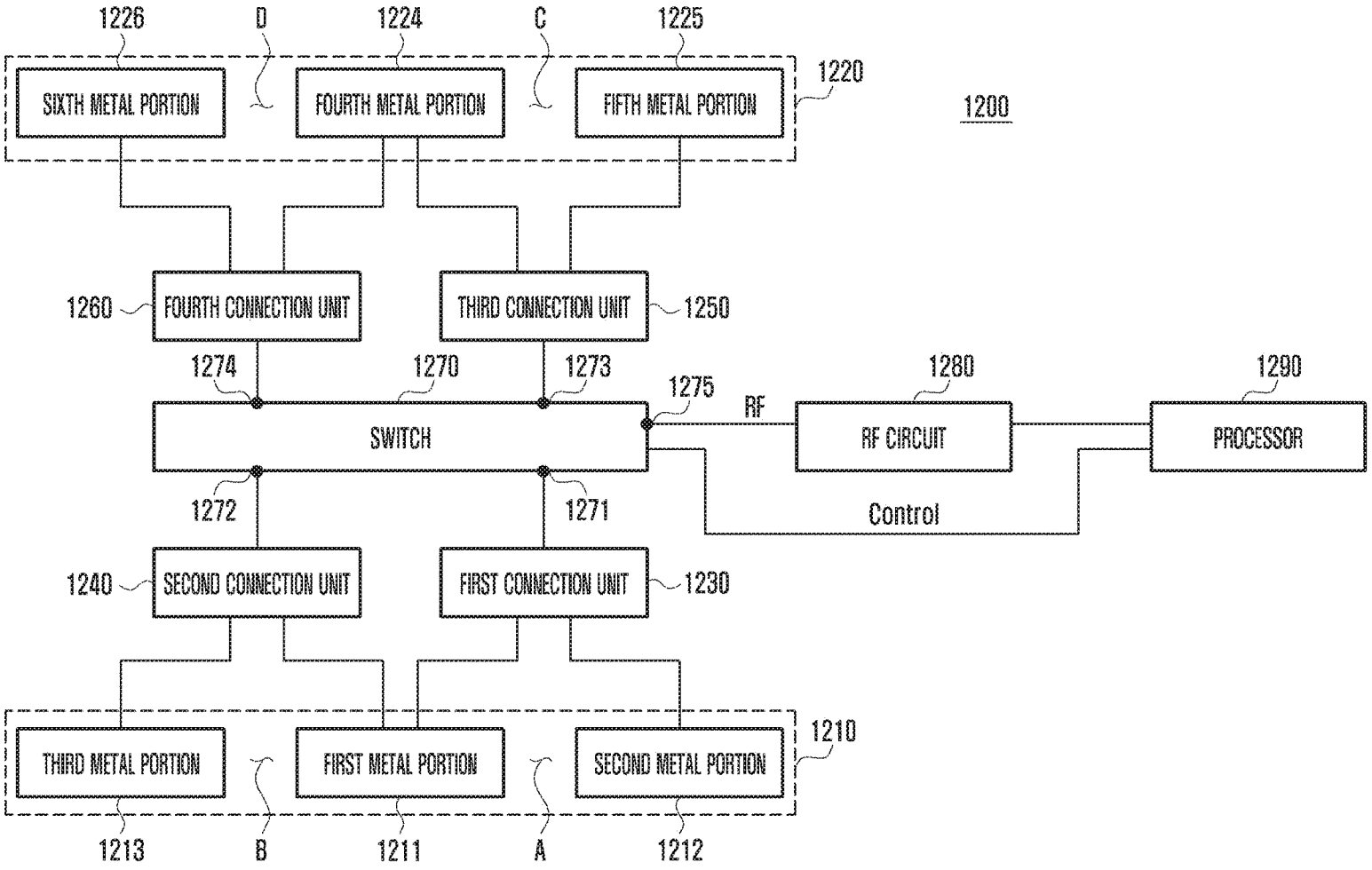
FIG. 12 is a block diagram illustrating an electric configuration of an electronic device according to various embodiments of the present disclosure.

FIG. 12 is a block diagram illustrating an electric configuration of an electronic device according to various embodiments of the present disclosure.

Referring to FIG. 12, an electronic device 1200 may have, for example, a configuration of the electronic device 101, and may include a first radiator 1210, a second radiator 1220, a first connection unit 1230, a second connection unit 1240, a third connection unit 1250, a fourth connection unit 1260, a switch 1270, an RF circuit 1280, and a processor 1290.

According to various embodiments of the present disclosure, the first radiator 1210 may form the bottom side cover (e.g., the bottom side cover 415 of FIG. 4A) or the left side cover (e.g., the right side cover 413 FIG. 4A) of the electronic device 1200, and may include a first metal portion 1211, a second metal portion 1212, and a third metal portion 1213. The first metal portion 1211, the second metal portion 1212, and the third metal portion 1213 may be spatially separated from each other. For example, a first gap A may be formed between the first metal portion 1211 and the second metal portion 1212, and a second gap B may be formed between the first metal portion 1211 and the third metal portion 1213. The first gap A and the second gap B may be formed of a dielectric material.

According to various embodiments of the present disclosure, the second radiator 1210 may form the top side cover (e.g., the top side cover 416 of FIG. 4B) or the right side cover (e.g., the left side cover 414 of FIG. 4A) of the electronic device 1200, and may include a fourth metal portion 1224, a fifth metal portion 1225, and a sixth metal portion 1226. The fourth metal portion 1224, the fifth metal portion 1225, and the sixth metal portion 1226 may be spatially separated from each other. For example, a third gap C may be formed between the fourth metal portion 1224 and the fifth metal portion 1225, and a fourth gap D may be formed between the fourth metal portion 1211 and the sixth metal portion 1226. The third gap C and the fourth gap D may be formed of a dielectric material.

According to various embodiments of the present disclosure, the first connection unit 1230 may electrically connect the first output port 1271 of the switch 1270 to the first metal portion 1211 and the second metal portion 1212. The first connection unit 1130 may be configured to be the same as, or at least partially similar to, the connection units 1122*a*, 1123*a*, 1124, and 1125*a* of FIG. 11. Accordingly, when power is fed from the first output port 1271 to the first connection unit 1230, resonance paths rp1 to rp5 may be formed by the first connection unit 1230, and the radiating efficiency of the RF signal radiated due to the resonance paths rp1 to rp5 may be measured as in graph 840 in FIG. 8C. According to a certain embodiment of the present disclosure, the first connection unit 1230 may include, instead of the fifth connection unit 1125*a*, a signal line that interconnects one point of the second connection unit 1122*a* and one point of the third connection unit 1123*a*. When the fifth connection unit 1125*a* is replaced by a signal line as described above, the second RF signal may be radiated due to the resonance paths rp1 to rp4, and the radiating efficiency thereof may be measured as in graph 830 in FIG. 8C.

According to various embodiments of the present disclosure, the second connection unit 1240 may electrically connect the second output port 1272 of the switch 1270 to the first metal portion 1211 and the third metal portion 1213. The second connection unit 1240 may be configured to be the same as, or at least partially similar to, the connection units 1122*b*, 1123*b*, 1127, and 1125*b* illustrated FIG. 11. Accordingly, when power is fed from the second output port 1272 to the second connection unit 1240, resonance paths rp6 to rp10 may be formed by the second connection unit 1240, and the radiating efficiency of the RF signal radiated due to the resonance paths rp6 to rp10 may be measured as in graph 840 in FIG. 8C. According to a certain embodiment of the present disclosure, the second connection unit 1240 may include, instead of the tenth connection unit 1125*b*, a signal line that interconnects one point of the eighth connection unit 1122*b* and one point of the ninth connection unit 1123*b*. When the tenth connection unit 1125*b* is replaced by a signal line as described above, the second RF signal may be radiated due to the resonance paths rp6 to rp9, and the radiating efficiency thereof may be measured as in graph 830 in FIG. 8C.

According to various embodiments of the present disclosure, the third connection unit 1250 may electrically connect the third output port 1273 of the switch 1270 to the fourth metal portion 1224 and the fifth metal portion 1225. The third connection unit 1250 may be configured to be the same as, or at least partially similar to, the connection units 1122*a*, 1123*a*, 1124, and 1125*a* illustrated in FIG. 11. Accordingly, when power is fed from the third output port 1273 to the third connection unit 1250, resonance paths rp11 to rp15 may be formed by the third connection unit 1250, and the radiating efficiency of the RF signal radiated due to the resonance paths rp11 to rp15 may be measured as in graph 840 in FIG. 8C. According to a certain embodiment of the present disclosure, the third connection unit 1250 may include, instead of the fifth connection unit 1125*a*, a signal line that interconnects one point of the second connection unit 1122*a* and one point of the third connection unit 1123*a*. When the fifth connection unit 1125*a* is replaced by a signal line as described above, the second RF signal may be radiated due to the resonance paths rp11 to rp14, and the radiating efficiency thereof may be measured as in graph 830 in FIG. 8C.

According to various embodiments of the present disclosure, the fourth connection unit 1260 may electrically connect the fourth output port 1274 of the switch 1270 to the fourth metal portion 1224 and the sixth metal portion 1226. The fourth connection unit 1260 may be configured to be the same as, or at least partially similar to, the connection units

1122*b*, 1123*b*, 1127, and 1125*b* illustrated FIG. 11. Accordingly, when power is fed from the fourth output port 1274 to the fourth connection unit 1260, resonance paths rp16 to rp20 may be formed by the fourth connection unit 1260, and the radiating efficiency of the second RF signal radiated due to the resonance paths rp16 to rp20 may be measured as in graph 840 in FIG. 8C. According to a certain embodiment of the present disclosure, the fourth connection unit 1260 may include, instead of the tenth connection unit 1125*b*, a signal line that interconnects one point of the eighth connection unit 1122*b* and one point of the ninth connection unit 1123*b*. When the tenth connection unit 1125*b* is replaced by a signal line as described above, the second RF signal may be radiated due to the resonance paths rp16 to rp19, and the radiating efficiency thereof may be measured as in graph 830 in FIG. 8C.

According to various embodiments of the present disclosure, the switch 1270 may electrically connect the input port 1275 to any one of the output ports 1271 to 1274. Such a selective connection may be controlled by the processor 1290.

According to various embodiments of the present disclosure, the RF circuit 1280 may convert data received from the processor 1290 into an RF signal, and may output the RF signal to the input port 1275.

According to various embodiments of the present disclosure, the processor 1290 may determine whether the radiating performance is deteriorated, and may control the switch 1270 based on the determination result. Here, a sensor (e.g., the sensor 950) may be used for the determination. In still another example, data related to the frequency characteristic of the RF signal received from the RF circuit 1180 may be used.

According to various embodiments of the present disclosure, when it is determined that the radiating performance has been deteriorated, the processor 1290 may adjust the inter-port connection. For example, when it is determined that the radiating performance of the RF signal output from the first output port 1271 has been deteriorated, the processor 1290 may determine the port to be connected with the input port 1275 as one of the other output ports 1272, 1273, and 1274. In addition, the processor 1290 may inspect the radiating performance of the RF signal radiated due to each of the output ports 1271 to 1274, and may determine the output port that exhibits the optimal radiating performance (e.g., the output port having the highest radiating efficiency) as that for use in data communication.

According to one embodiment of the present disclosure, the third metal portion 1213 and the sixth metal portion 1226 may be implemented by one metal. In addition, the second metal portion 1210 and the fifth metal portion 1225 may also be implemented by one metal. According to another embodiment of the present disclosure, the third metal portion 1213 and the sixth metal portion 1226 may be split from each other, and the second metal portion 1210 and the fifth metal portion 1225 may be split from each other.

According to various embodiments of the present disclosure, the electronic device may include: a housing; an RF circuit positioned within the housing and including a first port and a second port; a processor positioned within the housing and electrically connected to the RF circuit; and a ground member positioned within the housing.

The housing may include a first plate facing in a first direction, a second plate facing in a second direction that is opposite to the first direction, and a side member at least partially enclosing a space between the first plate and the second plate.

The side member may include a first conductive portion, a second conductive portion, a third conductive portion, a first non-conductive portion, and a second non-conductive portion.

The first non-conductive portion may be inserted between the first conductive portion and the second conductive portion.

The second non-conductive portion may be inserted between the first conductive portion and the third conductive portion.

The electronic device may further include: a first electric path connected between the first port and a first point of the first conductive portion; a second electric path connected between the second port and a first point of the second conductive portion; a third electric path connected between a second point of the first conductive portion and the ground member; a fourth electric path connected between a second point of the second conductive portion and the ground member; and a fifth electric path connected between one point of the second electric path and one point of the third electric path.

In addition, the electronic device may further include: a sixth electric path connected between a third point of the first conductive portion and the ground member.

The third point of the first conductive portion may be positioned between the first point and the second point of the first conductive portion.

The second point of the first conductive portion may be positioned between the first point of the first conductive portion and the first non-conductive portion.

The first point of the second conductive portion may be positioned between the second point of the second conductive portion and the first non-conductive portion.

The fifth electric path may include a metal plate electrically connected to the ground member, a tuning circuit configured to adjust a frequency characteristic of an RF signal, and a signal line configured to electrically connect one point of the second electric path to the tuning circuit and the metal plate.

A first electrode of the tuning circuit may be electrically connected to the signal line, and a second electrode of the tuning circuit may be electrically connected to one point of the third electric path.

The processor may be set to receive data related to a frequency characteristic of an RF signal from the RF circuit, and to adjust a characteristic of the tuning circuit based on the data.

In addition, the electronic device may further include: a sensor configured to detect a physical amount by being electrically connected to a conductive portion of the side member.

The processor may be set to adjust a characteristic of the tuning circuit based on the data received from the sensor.

A hole may be formed in the first conductive portion for a wired connection with an external device.

The RF circuit may output a first RF signal to the first port and a second RF signal to the second port.

The second RF signal may have a higher frequency than the first RF signal.

In addition, the electronic device may further include: a board positioned within the housing.

The board may be implemented using at least one of a PCB and FPCB, and may include the ground member.

The first electric path, the second electric path, the third electric path, the fourth electric path, and the fifth electric path may be provided on the board.

In addition, the electronic device may further include: a first contact terminal configured to connect the first electric path provided on the board to the first point of the first conductive portion; a second contact terminal configured to connect the second electric path provided on the board to the first point of the second conductive portion; a third contact terminal configured to connect the third electric path provided on the board to the second point of the first conductive portion; and a fourth contact terminal configured to connect the fourth electric path provided on the board to the second point of the second conductive portion.

Each of the first contact terminal, the second contact terminal, the third contact terminal, and the fourth contact terminal may include an elastic pin.

According to various embodiments of the present disclosure, an electronic device may include: a housing; an RF circuit positioned within the housing; a processor positioned within the housing and electrically connected to the RF circuit; a switch positioned within the housing; and a ground member positioned within the housing.

The housing may include a first plate facing in a first direction, a second plate facing in a second direction that is opposite to the first direction, and a side member at least partially enclosing a space between the first plate and the second plate.

The side member may include a first conductive portion, a second conductive portion, a third conductive portion, a first non-conductive portion, and a second non-conductive portion.

The first non-conductive portion may be inserted between the first conductive portion and the second conductive portion.

The second non-conductive portion may be inserted between the first conductive portion and the third conductive portion.

The switch may include an input port, a first output port, and a second output port.

The input port may be electrically connected to the RF circuit, and may be electrically connected to one of the first output port and the second output port.

In addition, the electronic device may further include: a first electric path connected between the first output port and a first point of the first conductive portion; a second electric path connected between a first point of the second conductive portion and the ground member; a third electric path connected between a second point of the second conductive portion and the ground member; a fourth electric path connected between one point of the first electric path and one point of the second electric path; a fifth electric path connected between the second output port and a first point of the third conductive portion; a sixth electric path connected between a second point of the first conductive portion and the ground member; a seventh electric path connected between a second point of the third conductive portion and the ground member; and an eighth electric path connected between one point of the fifth electric path and one point of the sixth electric path.

The first point of the second conductive portion may be positioned between the second point of the second conductive portion and the first non-conductive portion.

The first point of the third conductive portion may be positioned between the second point of the second conductive portion and the second non-conductive portion.

The RF circuit may include a first port and a second port, and the second port may be electrically connected with the input port of the switch.

In addition, the electronic device may further include: a ninth electric path connected between the first port and a third point of the first conductive portion; and a tenth electric path connected between a fourth point of the first conductive portion and the ground member.

The third point of the first conductive portion may be positioned between the second point and the fourth point of the first conductive portion.

The fourth point of the first conductive portion may be positioned between the third point and the first point of the first conductive portion.

The fourth electric path may include a first metal plate electrically connected to the ground member, a first tuning circuit configured to adjust a frequency characteristic of an RF signal, and a first signal line configured to electrically connect one point of the first electric path to the first tuning circuit and the metal plate.

A first electrode of the first tuning circuit may be electrically connected to the first signal line, and a second electrode of the second tuning circuit may be electrically connected to one point of the second electric path.

The eighth electric path may include a second metal plate electrically connected to the ground member, a second tuning circuit configured to adjust a frequency characteristic of the RF signal, and a second signal line configured to electrically connect one point of the fifth electric path to the second tuning circuit and the second metal plate.

A first electrode of the second tuning circuit is electrically connected to the second signal line, and a second electrode of the second tuning circuit may be electrically connected to one point of the sixth electric path.

The processor may be set to receive data related to a frequency characteristic of an RF signal from the RF circuit, and to connect one of the first output port and the second output port to the input port, based on the data.

In addition, the electronic device may further include a sensor configured to detect a physical amount by being electrically connected to a conductive portion of the side member.

The processor may be set to connect one of the first output port and the second output port to the input port based on the data received from the sensor.

The term "module" as used herein may, for example, mean a unit including one of hardware, software, and firmware or a combination of two or more of them. The "module" may be interchangeably used with, for example, the term "unit", "logic", "logical block", "component", or "circuit". The "module" may be a minimum unit of an integrated component element or a part thereof. The "module" may be a minimum unit for performing one or more functions or a part thereof. The "module" may be mechanically or electronically implemented. For example, the "module" according to the present disclosure may include at least one of an application-specific IC (ASIC) chip, a field-programmable gate arrays (FPGA), and a programmable-logic device for performing operations which has been known or are to be developed hereinafter.

According to various embodiments of the present disclosure, at least some of the devices (for example, modules or functions thereof) or the method (for example, operations) according to the present disclosure may be implemented by a command stored in a non-transitory computer-readable storage medium in a programming module form. When the command is executed by processors, the processors may perform a function corresponding to the command. The non-transitory computer-readable storage medium may be, for example, the memory 130. At least a part of the programming module may be implemented (e.g., executed) by a processor. At least a part of the programming module may include, for example, a module, a program, a routine, a set of instructions and/or a process for performing one or more functions.

The non-transitory computer readable recoding medium may include a hard disk, a floppy disk, magnetic media (e.g., a magnetic tape), optical media (e.g., a compact disc ROM (CD-ROM) and a DVD), magneto-optical media (e.g., a floptical disk), a hardware device (e.g., a ROM, a RAM, a flash memory), and the like. In addition, the program instructions may include high class language codes, which can be executed in a computer by using an interpreter, as well as machine codes made by a compiler. The aforementioned hardware device may be configured to operate as one or more software modules in order to perform the operation of the present disclosure, and vice versa.

The programming module according to the present disclosure may include one or more of the aforementioned components or may further include other additional components, or some of the aforementioned components may be omitted. Operations executed by a module, a programming module, or other component elements according to various embodiments of the present disclosure may be executed sequentially, in parallel, repeatedly, or in a heuristic manner. Further, some operations may be executed according to another order or may be omitted, or other operations may be added. Various embodiments disclosed herein are provided merely to easily describe technical details of the present disclosure and to help the understanding of the present disclosure, and are not intended to limit the scope of the present disclosure. Accordingly, the scope of the present disclosure should be construed as including all modifications or various other embodiments based on the technical idea of the present disclosure.

A module or a programming module according to the present disclosure may include at least one of the described component elements, a few of the component elements may be omitted, or additional component elements may be included. Operations executed by a module, a programming module, or other component elements according to various embodiments of the present disclosure may be executed sequentially, in parallel, repeatedly, or in a heuristic manner. Further, some operations may be executed according to another order or may be omitted, or other operations may be added.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a housing including:

a first plate facing in a first direction, a second plate facing in a second direction that is opposite to the first direction, and a side member at least partially enclosing a space between the first plate and the second plate, the side member includes:

a first conductive portion, a second conductive portion, a third conductive portion, a first non-conductive portion, and a second non-conductive portion, the first non-conductive portion being inserted between the first conductive portion and the second conductive portion, and the second non-conductive portion being inserted between the first conductive portion and the third conductive portion;

a radio frequency (RF) circuit disposed within the housing and including a first port and a second port;

a processor disposed within the housing and electrically connected to the RF circuit;

a ground member disposed within the housing;

a first electric path connected between the first port and a first point of the first conductive portion;

a second electric path connected between the second port and a first point of the second conductive portion;

a third electric path connected between a second point of the first conductive portion and the ground member;

a fourth electric path connected between a second point of the second conductive portion and the ground member;

a fifth electric path connected between one point of the second electric path and one point of the third electric path; and a sixth electric path connected between a third point of the first conductive portion and the ground member.

2. The electronic device of claim 1, wherein the third point of the first conductive portion is disposed between the first point and the second point of the first conductive portion.

3. The electronic device of claim 1, wherein the second point of the first conductive portion is disposed between the first point of the first conductive portion and the first non-conductive portion.

4. The electronic device of claim 1, wherein the first point of the second conductive portion is disposed between the second point of the second conductive portion and the first non-conductive portion.

5. The electronic device of claim 1, wherein the fifth electric path includes: a metal plate electrically connected to the ground member, a tuning circuit configured to adjust a frequency characteristic of an RF signal, and a signal line configured to electrically connect one point of the second electric path to the metal plate, wherein a first electrode of the tuning circuit is electrically connected to the signal line, and a second electrode of the tuning circuit is electrically connected to one point of the third electric path.

6. The electronic device of claim 5, wherein the processor is configured to:

receive data related to a frequency characteristic of an RF signal from the RF circuit, and adjust a characteristic of the tuning circuit based on the data.

7. The electronic device of claim 5, further comprising:

a sensor configured to detect a physical amount by being electrically connected to a conductive portion of the side member, wherein the processor is configured to adjust a characteristic of the tuning circuit based on the data received from the sensor.

8. The electronic device of claim 1, wherein a hole is formed in the first conductive portion for a wired connection with an external device.

9. The electronic device of claim 1, wherein the RF circuit is configured to output a first RF signal to the first port and a second RF signal to the second port, and wherein the second RF signal has a higher frequency than the first RF signal.

10. The electronic device of claim 1, further comprising:
a board disposed within the housing,
wherein the board is implemented using at least one of a printed circuit board (PCB) and flexible PCB (FPCB), and includes the ground member.

11. The electronic device of claim 10, wherein the first electric path, the second electric path, the third electric path, the fourth electric path, and the fifth electric path are disposed on the board.

12. The electronic device of claim 11, further comprising:
a first contact terminal configured to connect the first electric path disposed on the board to the first point of the first conductive portion;
a second contact terminal configured to connect the second electric path disposed on the board to the first point of the second conductive portion;
a third contact terminal configured to connect the third electric path disposed on the board to the second point of the first conductive portion; and
a fourth contact terminal configured to connect the fourth electric path disposed on the board to the second point of the second conductive portion.

13. The electronic device of claim 12, wherein each of the first contact terminal, the second contact terminal, the third contact terminal, and the fourth contact terminal includes an elastic pin.

14. An electronic device comprising:
a housing including:
a first plate facing in a first direction,
a second plate facing in a second direction that is opposite to the first direction, and
a side member at least partially enclosing a space between the first plate and the second plate, the side member includes:
a first conductive portion,
a second conductive portion, a third conductive portion, a first non-conductive portion, and
a second non-conductive portion, the first non-conductive portion is inserted between the first conductive portion and the second conductive portion, and the second non-conductive portion is inserted between the first conductive portion and the third conductive portion;
a radio frequency (RF) circuit disposed within the housing;
a processor disposed within the housing and electrically connected to the RF circuit;
a switch disposed within the housing, and including an input port, a first output port, and a second output port, wherein the input port is electrically connected to the RF circuit and electrically connected to one of the first output port and the second output port;
a ground member disposed within the housing;
a first electric path connected between the first output port and a first point of the second conductive portion;
a second electric path connected between a first point of the first conductive portion and the ground member;
a third electric path connected between a second point of the second conductive portion and the ground member;
a fourth electric path connected between one point of the first electric path and one point of the second electric path;
a fifth electric path connected between the second output port and a first point of the third conductive portion;
a sixth electric path connected between a second point of the first conductive portion and the ground member;
a seventh electric path connected between a second point of the third conductive portion and the ground member; and
an eighth electric path connected between one point of the fifth electric path and one point of the sixth electric path.

15. The electronic device of claim 14,
wherein the first point of the second conductive portion is disposed between the second point of the second conductive portion and the first non-conductive portion, and
wherein the first point of the third conductive portion is disposed between the second point of the second conductive portion and the second non-conductive portion.

16. The electronic device of claim 14,
wherein the RF circuit includes a first port and a second port that is electrically connected with the input port of the switch, and
wherein the electronic device further includes:
a ninth electric path connected between the first port and a third point of the first conductive portion; and
a tenth electric path connected between a fourth point of the first conductive portion and the ground member.

17. The electronic device of claim 16,
wherein the third point of the first conductive portion is disposed between the second point and the fourth point of the first conductive portion, and
wherein the fourth point of the first conductive portion is disposed between the third point and the first point of the first conductive portion.

18. The electronic device of claim 14,
wherein the fourth electric path includes:
a first metal plate electrically connected to the ground member,
a first tuning circuit configured to adjust a frequency characteristic of an RF signal, and
a first signal line configured to electrically connect one point of the first electric path to the first tuning circuit and the metal plate,
wherein a first electrode of the first tuning circuit is electrically connected to the first signal line, and a second electrode of the first tuning circuit is electrically connected to one point of the second electric path, and
wherein the eighth electric path includes:
a second metal plate electrically connected to the ground member,
a second tuning circuit configured to adjust a frequency characteristic of the RF signal, and
a second signal line configured to electrically connect one point of the fifth electric path to the second tuning circuit and the second metal plate,
wherein a first electrode of the second tuning circuit is electrically connected to the second signal line, and a second electrode of the second tuning circuit is electrically connected to one point of the sixth electric path.

19. The electronic device of claim 14, wherein the processor is configured to:
receive data related to a frequency characteristic of an RF signal from the RF circuit, and
connect one of the first output port and the second output port to the input port based on the data.

20. The electronic device of claim 14, further comprising:
a sensor configured to detect a physical amount by being electrically connected to a conductive portion of the side member, wherein the processor is configured to connect one of the first output port and the second output port to the input port based on the data received from the sensor.

* * * * *